US008791352B2

(12) United States Patent
Takahashi

(10) Patent No.: US 8,791,352 B2
(45) Date of Patent: Jul. 29, 2014

(54) ELECTROSTATIC SPEAKER UNIT FOR MUSICAL INSTRUMENT

(71) Applicant: Yamaha Corporation, Hamamatsu (JP)

(72) Inventor: Yuji Takahashi, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 13/740,474

(22) Filed: Jan. 14, 2013

(65) Prior Publication Data

US 2013/0180387 A1 Jul. 18, 2013

(30) Foreign Application Priority Data

Jan. 13, 2012 (JP) ..... 2012-005598
Jan. 13, 2012 (JP) ..... 2012-005599
Jan. 13, 2012 (JP) ..... 2012-005600

(51) Int. Cl.
*G10H 3/00* (2006.01)
*G10H 1/32* (2006.01)

(52) U.S. Cl.
USPC ..... 84/743; 381/387; 381/119

(58) Field of Classification Search
USPC ..... 84/743; 381/387, 118
See application file for complete search history.

(56) References Cited

U.S. PATENT DOCUMENTS 6,399,870 B1 * 6/2002 Azima et al. ..... 84/744
6,696,633 B2 * 2/2004 Miyagishima et al. ..... 84/737
6,888,058 B2 * 5/2005 Urai et al. ..... 84/737
7,002,070 B2 * 2/2006 Katz ..... 84/718
7,060,890 B2 * 6/2006 Sato et al. ..... 84/745
7,078,611 B2 * 7/2006 Izumi et al. ..... 84/743
7,119,269 B2 * 10/2006 Furuhashi ..... 84/744
7,329,812 B2 2/2008 Kuwahara et al.
7,332,669 B2 * 2/2008 Shadd ..... 84/742
7,396,994 B2 * 7/2008 Izumi ..... 84/746
7,968,788 B2 * 6/2011 Shinjo et al. ..... 84/743
8,039,725 B2 * 10/2011 Kato et al. ..... 84/744
8,084,680 B2 * 12/2011 Kato et al. ..... 84/743
8,502,062 B2 * 8/2013 Mishima et al. ..... 84/743
2002/0141164 A1 10/2002 Watanabe et al.
2004/0182223 A1 9/2004 Kuwahara et al.
2005/0069159 A1 3/2005 Nakazato
2012/0006185 A1 * 1/2012 Mishima et al. ..... 84/744

FOREIGN PATENT DOCUMENTS

JP 62-42333 U 3/1987
JP 7-226991 A 8/1995
JP 7-49511 Y2 11/1995
JP 2571343 Y2 2/1998
JP 2002-359890 A 12/2002

(Continued)

OTHER PUBLICATIONS

Japanese Office Action for corresponding JP 2012-005599, dated Nov. 5, 2013. English translation provided.

*Primary Examiner* — Jeffrey Donels
(74) *Attorney, Agent, or Firm* — Rossi Kimms & McDowell LLP

(57) ABSTRACT

A speaker unit used for a musical instrument and configured to generate music sounds based on a performance operation in a main body of the musical instrument, including: an electrostatic speaker; and a stationary portion which is a portion fixed to the main body of the musical instrument or which is a member attachable to the main body of the musical instrument, wherein the electrostatic speaker is supported by the stationary portion such that at least one of a position and a posture of the electrostatic speaker with respect to the stationary portion is variable.

20 Claims, 11 Drawing Sheets

(56) References Cited

FOREIGN PATENT DOCUMENTS

| | | | |
|---|---|---|---|
| JP | 2003-173185 | A | 6/2003 |
| JP | 2003-263165 | A | 9/2003 |
| JP | 2004-302419 | A | 10/2004 |
| JP | 2005-109672 | A | 4/2005 |
| JP | 2005-221543 | A | 8/2005 |
| JP | 4207742 | B2 | 10/2008 |
| JP | 2010-068053 | A | 3/2010 |

* cited by examiner

ELECTROSTATIC SPEAKER UNIT FOR MUSICAL INSTRUMENT

CROSS REFERENCE TO RELATED APPLICATION

The present application claims priority from Japanese Patent Application No. 2012-005598 filed on Jan. 13, 2012, No. 2012-005599 filed on Jan. 13, 2012, and No. 2012-005600 filed on Jan. 13, 2012, the disclosure of which is herein incorporated by reference in its entirety.

BACKGROUND OF THE INVENTION

1. Field of the Invention

The present invention relates to a speaker unit for a musical instrument including an electrostatic speaker and configured to generate musical sounds based on a performance operation in a musical instrument main body. The present invention also relates to an electronic keyboard musical instrument and an electronic musical instrument including the speaker unit.

2. Discussion of Related Art

There has been conventionally known a speaker called an electrostatic speaker or a planar speaker as disclosed in the following Patent Literature 1. The electrostatic speaker is constituted by two electrodes which are opposed to each other with a spacing interposed therebetween and a sheet-like oscillating member having electric conductivity and interposed between the two electrodes. When a voltage applied to the electrodes is changed in a state in which a suitable bias voltage is applied to the oscillating member, an electrostatic force that acts on the oscillating member is changed, whereby the oscillating member is displaced. By changing the application voltage in accordance with acoustic signals to be inputted, the oscillating member is repeatedly displaced, namely, the oscillating member oscillates, so that reproduced waves in accordance with the acoustic signals are generated from the oscillating member.

Since the electrostatic speaker is inferior in acoustic characteristics in the bass range, the electrostatic speaker is not employed positively as a main speaker in electronic musical instruments. The electrostatic speaker, however, has characteristics that a cone speaker does not have.

For instance, in the electrostatic speaker, the larger the area of a planar plate of the electrostatic speaker, the stronger the sound directivity in a direction perpendicular to the planar plate. Consequently, the electrostatic speaker offers a property ensuring that sounds reach far. Further, in the electrostatic speaker, sounds can be emitted from both surfaces thereof. In particular, a thin and flexible electrostatic speaker is small in size and light in weight, and has flexibility that enables the electrostatic speaker to be curved or twisted, ensuring a freedom in shape.

Patent Literature 1: JP-A-2010-68053
Patent Literature 2: JP-A-2003-263165
Patent Literature 3: JP-A-2003-173185

In the meantime, with regard to the cone speaker, there has been known an electronic musical instrument in which an orientation of the cone speaker is variable relative to an instrument main body (Patent Literatures 2 and 3).

SUMMARY OF THE INVENTION

Conventionally, however, it has not been thoroughly studied to apply the electrostatic speaker to a musical instrument main body while taking full advantage of its characteristics. By taking full advantage of the characteristics of the electrostatic speaker, there is a possibility to realize a variety of acoustics (sounds) which are different from those of a musical instrument in which only the cone speaker is incorporated.

The present invention has been developed to solve the conventionally experienced problems described above. It is therefore an object of the invention to provide a speaker unit for a musical instrument in which perception of a position of a sound generation source and a sense of sound spread are variable and which can variously change acoustics (sounds) felt by a player of the musical instrument.

The object indicated above may be attained according to one aspect of the present invention, which provides a speaker unit (30; 120, 124) used for a musical instrument and configured to generate music sounds based on a performance operation in a main body (1; 110) of the musical instrument, comprising:

an electrostatic speaker (31; 124); and a stationary portion (20; 120) which is a portion fixed to the main body of the musical instrument or which is a member attachable to the main body of the musical instrument, wherein the electrostatic speaker is supported by the stationary portion such that at least one of a position and a posture of the electrostatic speaker with respect to the stationary portion is variable.

The object indicated above may be attained according to another aspect of the present invention, which provides an electronic keyboard musical instrument, comprising:

the speaker unit (30; 120, 124) defined as described above, the main body (110) defined as described above in which a keyboard portion is disposed; and a keyboard lid (120; 59) configured to pivot with respect to the main body by an opening/closing operation so as to be selectively in: a closed state in which the keyboard lid covers the keyboard portion; and an open state in which the keyboard lid uncovers the keyboard portion such that the keyboard portion is operable for performance, wherein the electrostatic speaker (31; 124) is incorporated in the keyboard lid.

The object indicated above may be attained according to still another aspect of the present invention, which provides an electronic musical instrument, comprising the speaker unit defined as described above, wherein the stationary portion (20) may have a first guiding portion (21) and a second guiding portion (22) which are formed on a common plane. The electronic musical instrument may further comprise a movable portion (10; 59) having a first guided portion (11) and a second guided portion (12) which engage the first guiding portion and the second guiding portion, respectively, the movable portion being movable with respect to the stationary portion with the first guided portion and the second guided portion supported by the first guiding portion and the second guiding portion, respectively. The electrostatic speaker (31) may be disposed at the movable portion. The first guiding portion and the second guiding portion may be formed such that at least a part of one of the first guiding portion and the second guiding portion is curved as viewed from a direction perpendicular to the common plane or at least a part of the first guiding portion and at least a part of the second guiding portion are curved in mutually different directions or curved in mutually different curvatures, as viewed from the direction perpendicular to the common plane.

The reference numerals in the brackets attached to respective constituent elements in the above description correspond to reference numerals used in the following embodiments to identify the respective constituent elements. The reference numerals attached to each constituent element indicates a correspondence between each element and its one example, and each element is not limited to the one example.

FORMS OF THE INVENTION

There will be explained various forms of an invention which is considered claimable. (Hereinafter, the invention which is considered claimable is referred to as "the claimable invention" where appropriate. The claimable invention includes at least "the present invention" and "the invention of the present application" which are inventions described in the appended claims. The claimable invention may include subordinate concepts of the present invention, superordinate concepts of the present invention, and an invention of another concept.) Each of the forms is numbered like the appended claims and depends from the other form or forms, where appropriate. This is for easier understanding of the claimable invention, and it is to be understood that combinations of constituent elements that constitute the invention are not limited to those described in the following forms. That is, it is to be understood that the claimable invention shall be construed in the light of the following description of various forms and embodiments, related art, etc. It is to be further understood that any form in which one or more constituent elements is/are added to or deleted from any one of the following forms may be considered as one form of the claimable invention.

(1) An electronic keyboard musical instrument, comprising:

a main body in which a keyboard portion is disposed; and a keyboard lid configured to pivot with respect to the main body by an opening/closing operation so as to be selectively placed in: a closed state in which the keyboard lid covers the keyboard portion; and an open state in which the keyboard lid uncovers the keyboard portion such that the keyboard portion is operable for performance, wherein an electrostatic speaker is incorporated in the keyboard lid.

(2) The electronic keyboard musical instrument according to the form (1), further comprising a position keeping device configured to keep the keyboard lid at at least one position within an entire pivotable range of the keyboard lid.

(3) The electronic keyboard musical instrument according to the form (1), wherein the keyboard lid is pivotally supported by a pivot member configured to pivot with respect to the main body.

(4) The electronic keyboard musical instrument according to the form (1), wherein the electrostatic speaker is supported by the keyboard lid so as to be relatively pivotable with respect to the keyboard lid.

(5) The electronic keyboard musical instrument according to the form (1), wherein the keyboard lid has a main portion and a front portion, the main portion being located above the keyboard portion while the front portion being located on a front side of the keyboard portion when the keyboard lid is in the closed state, and wherein the electrostatic speaker is disposed in the main portion of the keyboard lid and is capable of emitting sounds from both of a first surface and a second surface of the main portion, the first surface and the second surface being an upper surface and a lower surface of the main portion, respectively, in the closed state of the keyboard lid.

(6) The electronic keyboard musical instrument according to the form (1), wherein the keyboard lid is formed with a plurality of sound emission openings from which sounds of the electrostatic speaker are emitted, and wherein the keyboard lid has a shutter member configured to move for opening and closing the plurality of sound emission openings.

(7) The electronic keyboard musical instrument according to the form (1), wherein the electrostatic speaker is disposed so as to extend over an entire width of a keyboard portion of the keyboard musical instrument.

(8) A movement structure of a movable portion of a musical instrument, comprising:

a stationary portion which is stationary with respect to a main body of the musical instrument, the stationary portion having a first guiding portion and a second guiding portion formed on a common plane; and a movable portion having a first guided portion and a second guided portion which engage the first guiding portion and the second guiding portion, respectively, the movable portion being movable with respect to the stationary portion with the first guided portion and the second guided portion supported by the first guiding portion and the second guiding portion, respectively, wherein the first guiding portion and the second guiding portion are formed such that at least a part of one of the first guiding portion and the second guiding portion is curved as viewed from a direction perpendicular to the common plane or at least a part of the first guiding portion and at least a part of the second guiding portion are curved in mutually different directions or curved in mutually different curvatures, as viewed from the direction perpendicular to the common plane.

(9) The movement structure according to the form (8), wherein both of the first guiding portion (21) and the second guiding portion (22) are curved in opposite directions.

(10) The movement structure according to the form (8), wherein a concave side of a curved portion of the first guiding portion (21) and a concave side of a curved portion of the second guiding portion (22) are opposed to each other.

(11) The movement structure according to the form (8), wherein the first guiding portion and the second guiding portion are configured such that, where a position of the first guiding portion is translated in parallel with a phantom straight line, the curved portion of the first guiding portion and the curved portion of the second guiding portion are symmetric about the phantom straight line.

(12) The movement structure according to the form (8), wherein a movement locus of a middle position between the first guided portion and the second guided portion in the movable portion is substantially linear over an entire range of the movement of the movable portion.

(13) The movement structure according to the form (8), further comprising:

a pinion provided at the middle position in the movable portion; and a rack portion provided at the stationary portion, the rack portion having rack teeth arranged in a straight line and meshing with the pinion.

(14) The movement structure according to the form (8), wherein the first guiding portion is constituted by a straight portion and a curved portion which is contiguous to the straight portion, and the second guiding portion is constituted by a straight portion and a curved portion which is contiguous to the straight portion, the straight portion of the first guiding portion and the straight portion of the second guiding portion being parallel to each other.

BRIEF DESCRIPTION OF DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be hereinafter explained embodiments of the invention with reference to the drawings.

Figure 1B:
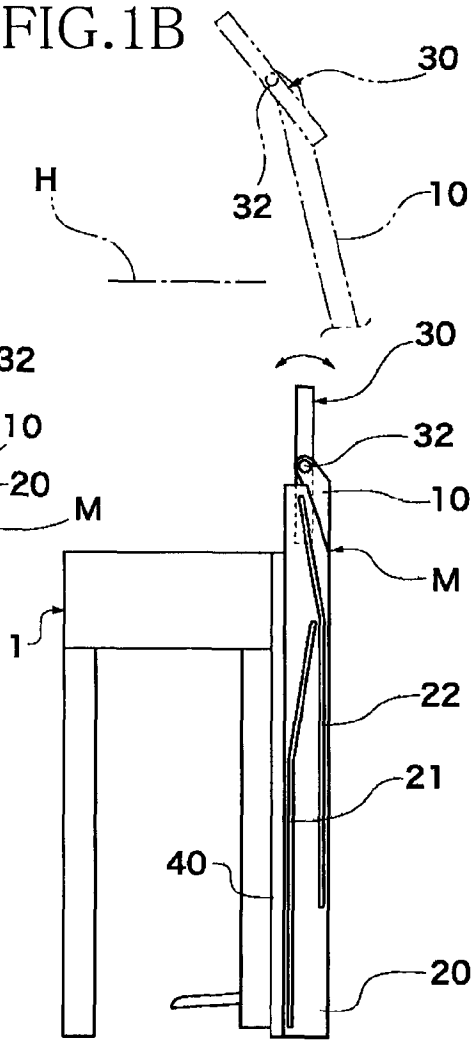
FIGS. 1A and 1B are a front view and a right side view, respectively, of an electronic musical instrument having a speaker unit for a musical instrument to which is applied a movement structure of a movable portion according to a first embodiment of the invention.
Figure 1A:
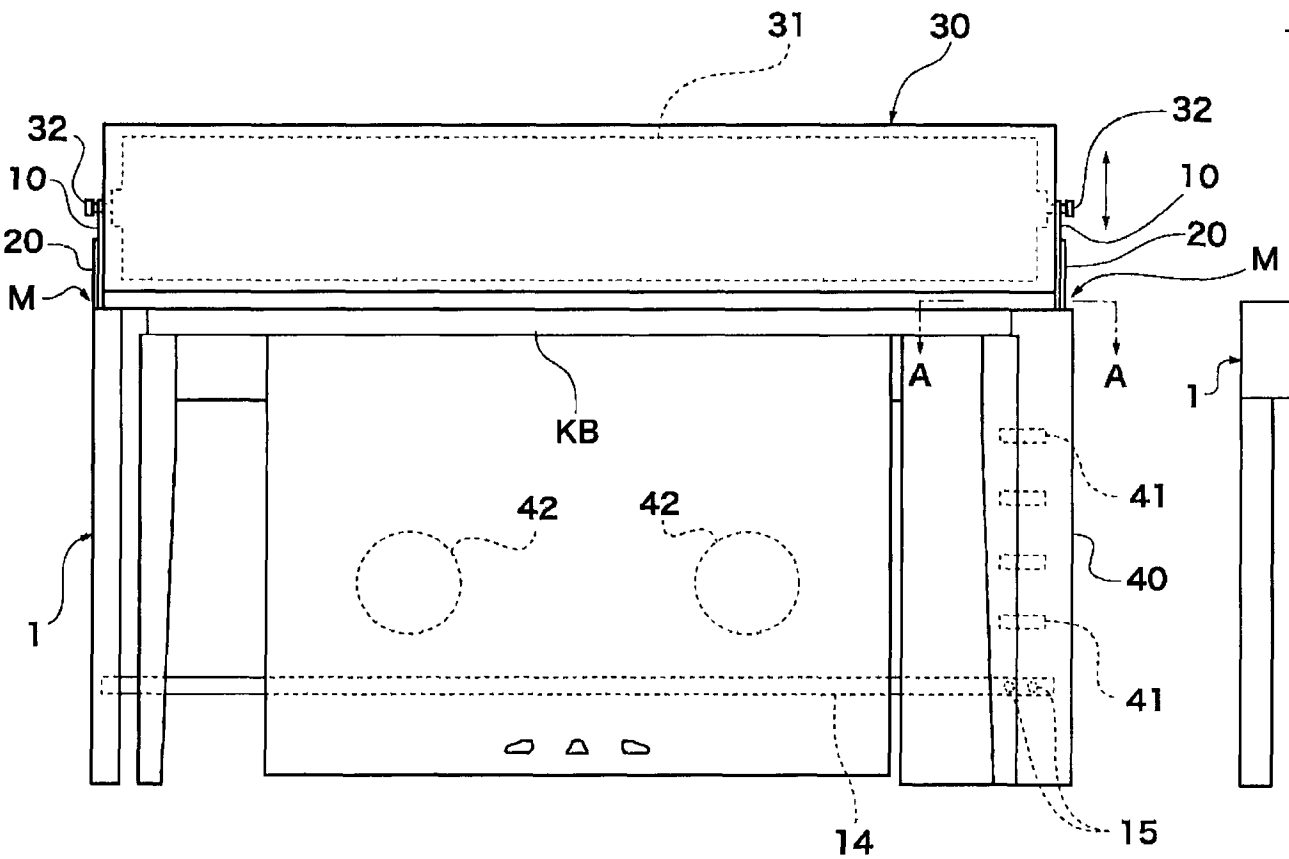

FIGS. 1A and 1B are a front view and a right side view, respectively, of an electronic musical instrument having a speaker unit for a musical instrument to which is applied a movement structure of a movable portion according to a first embodiment of the invention. In the following explanation, the terms "up-and-down direction" and "left-and-right direction" are used based on the up-and-down direction and the left-and-right direction in FIG. 1A. As for the term "front-and-rear direction", the side on which a player of the electronic musical instrument is situated, namely, the front side of the electronic musical instrument as seen in FIG. 1A, is referred to as "front".

The electronic musical instrument according to the present embodiment is constituted as an electronic keyboard musical instrument including an instrument main body 1 in which a keyboard portion KB is disposed. A pair of right and left cone speakers 42 are provided below the keyboard portion KB.

In the instrument main body 1, a TLF (Thin Light Flexible) unit 30 in which an electrostatic speaker 31 is incorporated is movably disposed as the speaker unit for the musical instrument. As will be explained in detail, the TLF unit 30 is configured to be movable by movement mechanisms M substantially in the up-and-down direction with respect to the instrument main body 1, such that the height of the TLF unit 30 is adjustable. Further, the orientation of the TLF unit 30 is adjustable such that the TLF unit 30 is pivotable about pivot shaft portions 32 such that a speaker surface of the electrostatic speaker 31 faces upward or downward.

Figure 2:
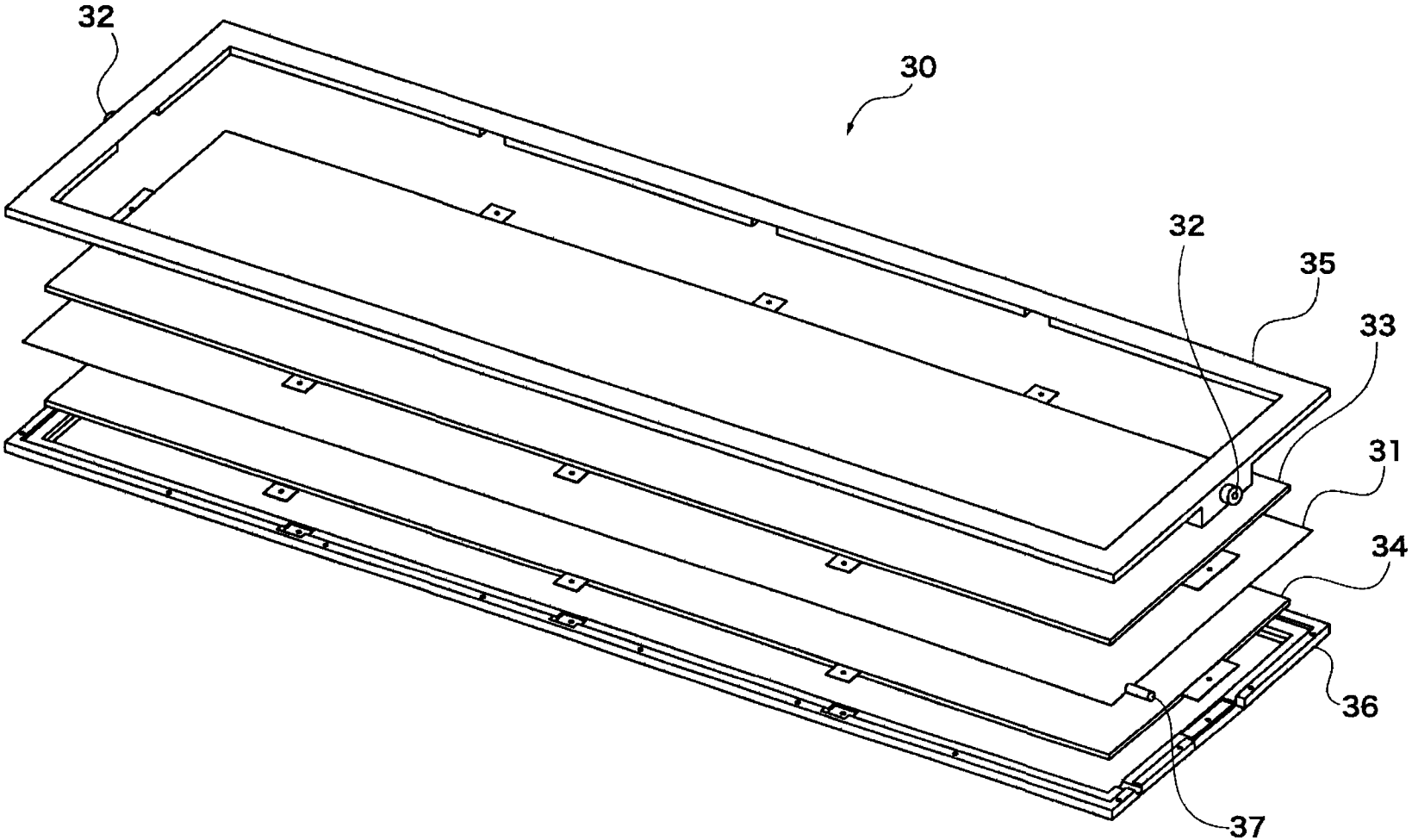
FIG. 2 is an exploded perspective view showing a structure of a TLF unit.

FIG. 2 is an exploded perspective view showing a structure of the TLF unit 30.

The TLF unit 30 includes frames 35, 36 between which an outer peripheral portion of the electrostatic speaker 31 is sandwiched, and openings are covered by respective punching metals 33, 34 in which a multiplicity of sound emission openings are formed. The longitudinal direction of the frame 35 coincides with a key arrangement direction in which keys of the keyboard portion KB are arranged. At longitudinally opposite ends of the frame 35, pivot shaft portions 32 are provided such that the center axis thereof is parallel to the key arrangement direction. At one of the longitudinally opposite ends of the frame 35, there is provided a terminal portion 37 to which a wiring cable is to be connected.

The electrostatic speaker 31 has a known structure such as the structure disclosed in JP-A-2010-68053. The electrostatic speaker 31 is the so-called planar speaker which is thin and light-weight and which has pliability and flexibility. The planar speaker generates a plane wave and is characterized by having high degrees of directivity and the property ensuring that sounds reach far.

As shown in FIG. 1, the movement mechanisms M are provided respectively at left-side and right-side end portions of the instrument main body 1. The movement mechanisms M are constituted so as to be left-right symmetric, except portions thereof. The right-side movement mechanism M includes, as principal constituent elements, a base body 40, a stationary plate 20, and a movable plate 10. The right-side movement mechanism M will be explained in detail.

Figure 3:
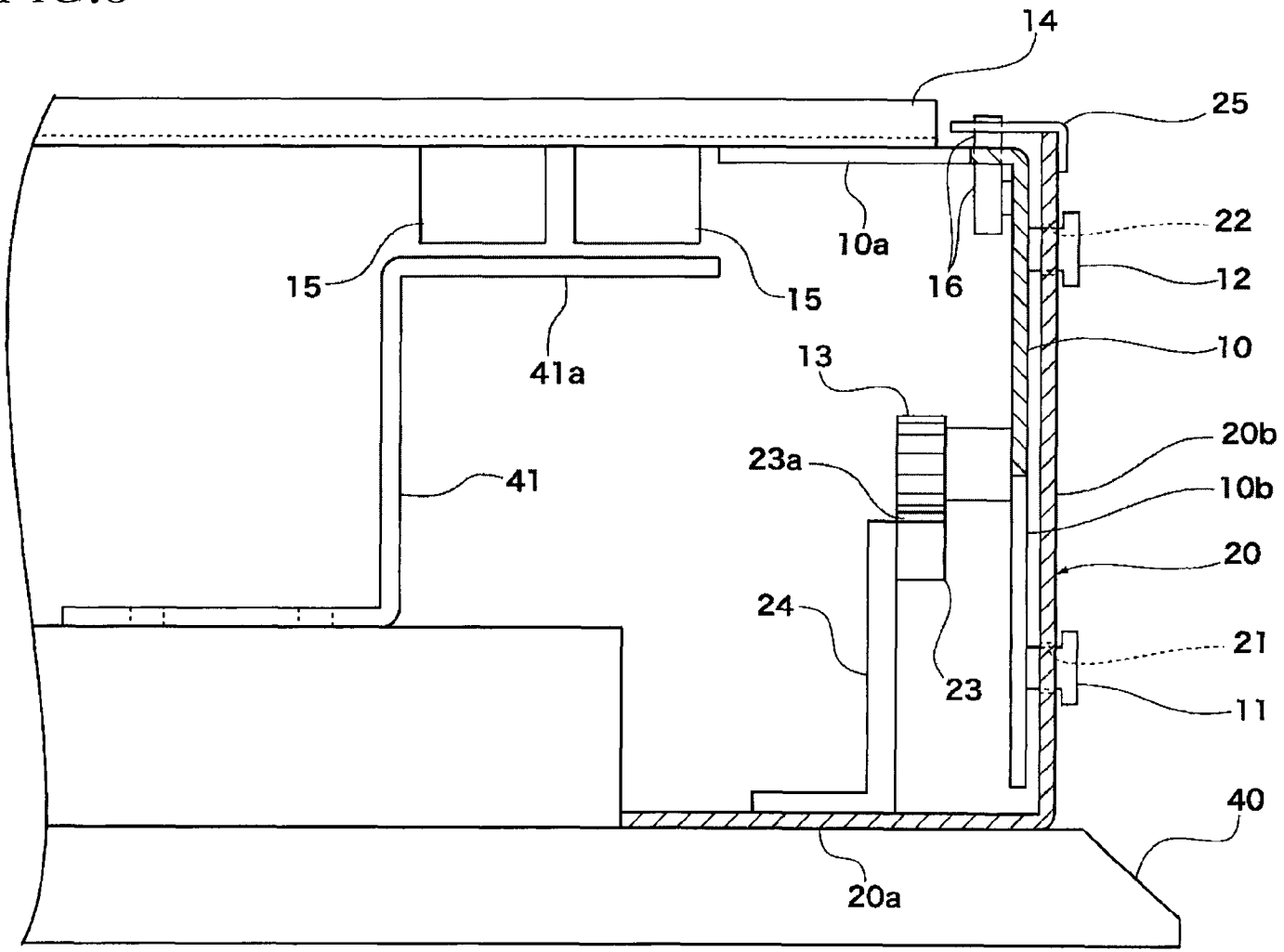
FIG. 3 is a cross-sectional view of a right-side movement mechanism taken along line A-A in FIG. 1A.
Figure 4:
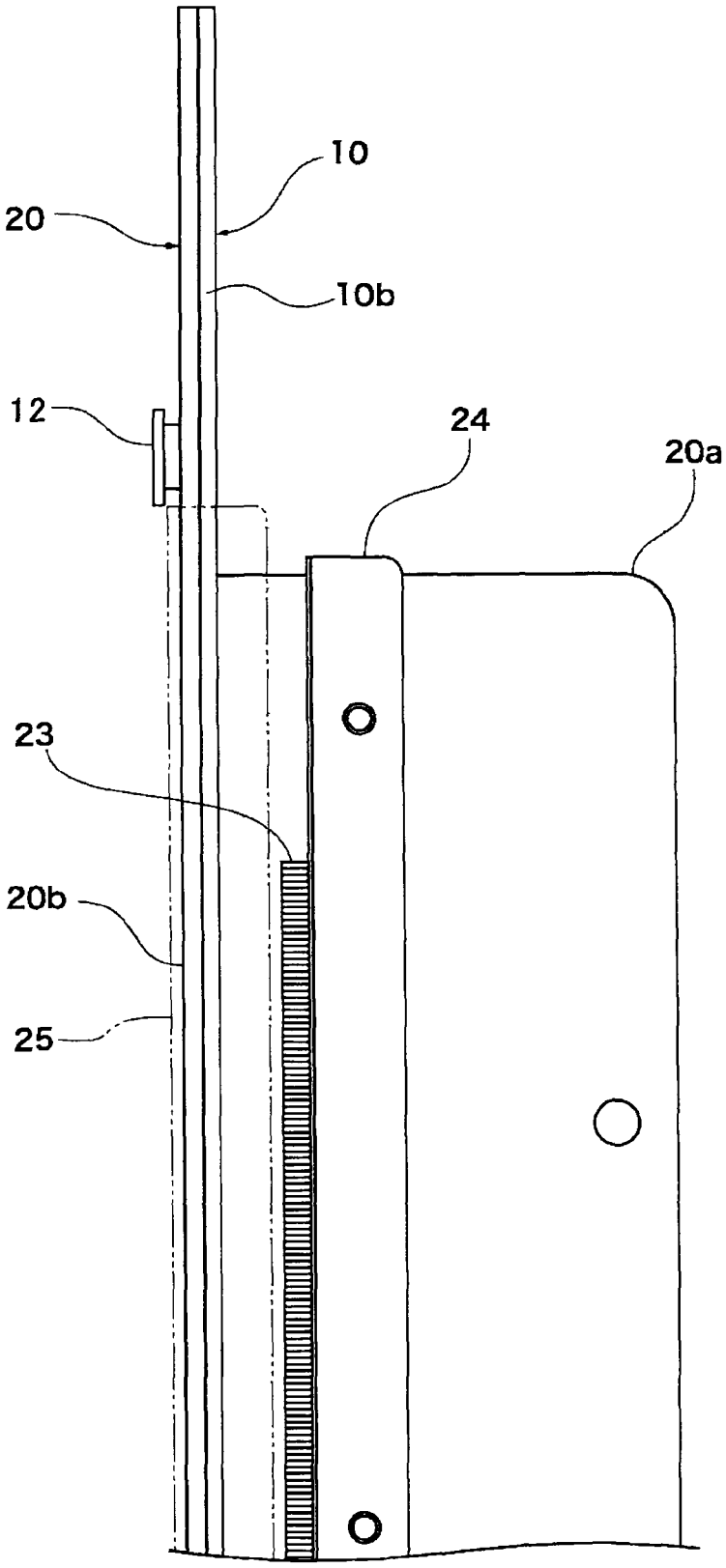
FIG. 4 is a rear view showing an upper portion of the right-side movement mechanism.
Figure 5A:
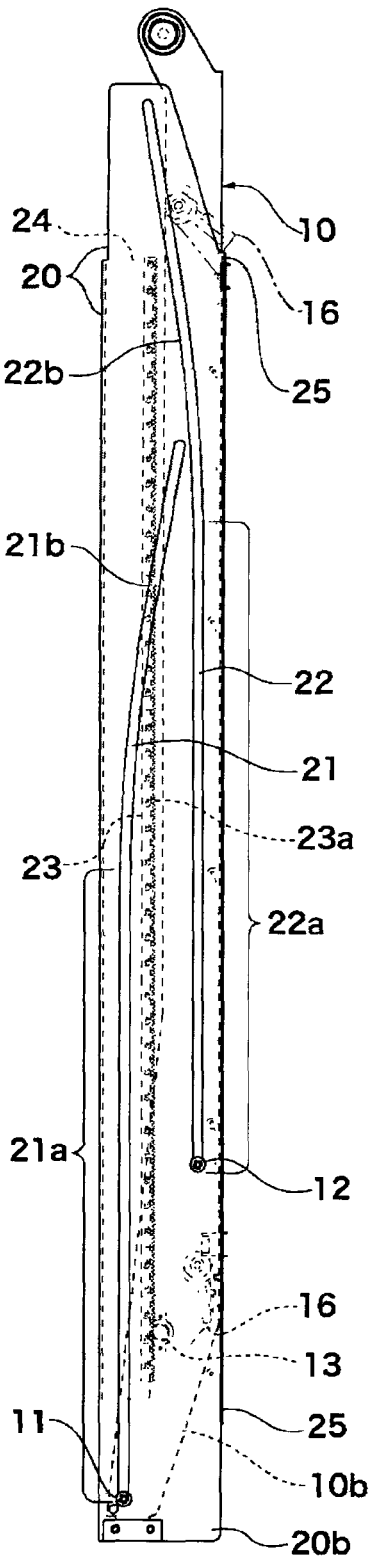
FIGS. 5A-5C are right side views of a stationary plate and a movable plate of the right-side movement mechanism.
Figure 5B:
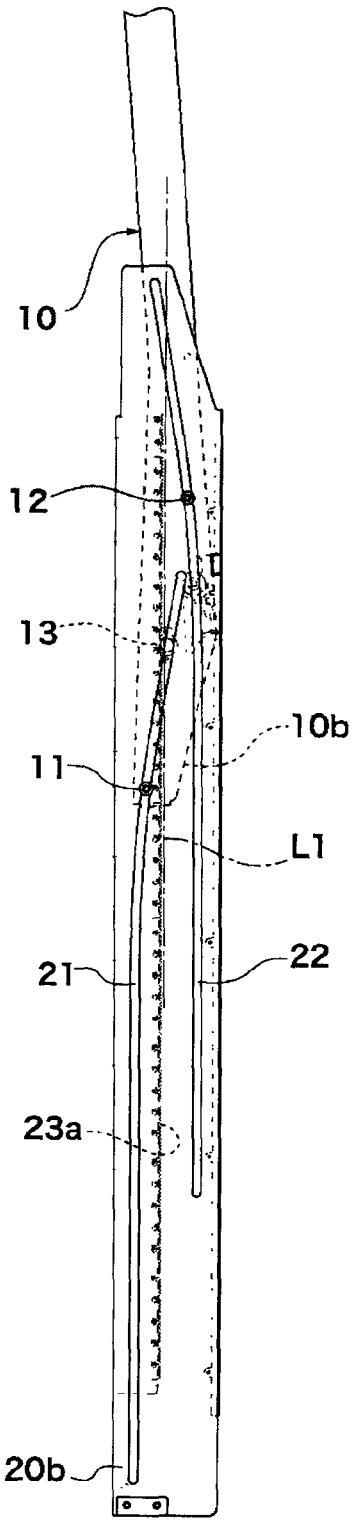
Figure 5C:
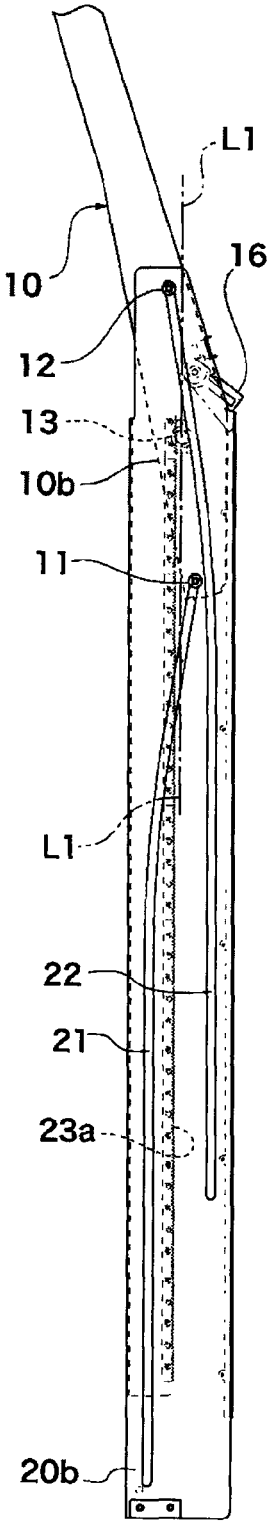

FIG. 3 is a cross-sectional view of the right-side movement mechanism M taken along line A-A in FIG. 1A. FIG. 4 is a rear view showing an upper portion of the right-side movement mechanism M. FIGS. 5A-5C are right side views of the stationary plate 20 and the movable plate 10 of the right-side movement mechanism M.

The movable plate 10 as a movable portion is configured to be slidingly movable in the up-and-down direction with respect to the stationary plate 20 as a stationary portion. Each of FIGS. 1A and 5A shows an initial state in which the movable plate 10 is located at the lowest position (lower limit position, initial position). Each of FIGS. 4, 5B, and 5C shows a state in which the movable plate 10 is located at a position within a movement range of the movable plate 10, namely, the movable plate 10 is moving in the movement range. In FIG. 1B, the movable plate 10 which is located at the highest position (upper limit position) is indicated by the phantom line.

The base body 40 is fixed to the instrument main body 1. As shown in FIG. 3, a plurality of Z-shaped bent members 41 are fixed to the back surface of the base body 40 at mutually different positions in the vertical direction. (Refer also to FIG. 1A.) Each of the Z-shaped bent members 41 is formed of a metal having magnetism. The stationary plate 20 is formed of a sturdy metal member which is bent in an L-shape in top plan view. The stationary plate 20 has a front plate portion 20*a* and a side plate portion 20*b*. The front plate portion 20*a* of the stationary plate 20 is fixed to the base body 40, whereby the stationary plate 20 is fixedly attached to the instrument main body 1 via the base body 40. Since the stationary plate 20 pivotally supports the TLF unit 30 with respect to the instrument main body 1 as explained below, the stationary plate 20 functions as a support portion.

An L-shaped rack support member 24 is fixed to the back surface of the front plate portion 20*a*. A rack portion 23 is fixed to the rack support member 24. On the back side of the rack portion 23, rack teeth 23*a* are formed. The rack teeth 23*a* face backward and are arranged in a straight line in the vertical direction, as shown in FIGS. 4 and 5. A cover 25 is fixed to a rear end of the side plate portion 20*b* of the stationary plate 20.

The movable plate 10 constituted by a sturdy member formed of a metal, for instance, is disposed inwardly of the L-shaped stationary plate 20. The movable plate 10 includes a side plate portion 10*b*. At a lower position of a rear part of the side plate portion 10*b*, a rail attachment portion 10*a* is integrally formed. To the rail attachment portion 10*a*, a right end portion of a rail member 14 is fixed. A left end portion of the rail member 14 is fixed to a rail attachment portion (not shown) of the left-side movement mechanism M. Thus, the rail member 14 extends over a substantially entire width of the keyboard portion KB, as shown in FIG. 1A.

Both of a main portion of the side plate portion 10*b* of the movable plate 10 and a main portion of the side plate portion 20*b* of the stationary plate 20 are parallel to the front-and-back direction and are parallel to the up-and-down direction. On the inner side of the side plate portion 10*b* of the movable plate 10, there is rotatably provided a pinion 13 meshing with the rack teeth 23*a*. Two engagement pins 11, 12 are provided on the side plate portion 10*b* so as to protrude outward therefrom. The pinion 13 is disposed at a middle position between the engagement pin 11 and the engagement pin 12, as shown in FIG. 5.

A stopper 16 is provided at the rear part of the side plate portion 10*b*. The stopper 16 is pivotally supported about an axis parallel to the left-and-right direction. The stopper 16 is in a pushed state in the counterclockwise direction in FIGS. 5A-5C, and a pivotal movement of the stopper 16 in the counterclockwise direction is restricted at a prescribed position by a restricting member not shown. When the movable plate 10 is in the initial state (i.e., when the movable plate 10 is located at the lower limit position (the lowest position) shown in FIG. 5A) or when the movable plate 10 is located above the lower limit position and below the upper limit position (the highest position), the stopper 16 is held in contact with an inner wall of the cover 25 as shown in FIGS. 5A and 5B, whereby the stopper 16 is inhibited from rotating. When the movable plate 10 reaches the upper limit position of the movement range, the stopper 16 is restricted so as to be located at the prescribed position in the counterclockwise direction and is placed in a locked state in which the stopper 16 engages the upper end of the cover 25, as shown in the upper part of FIG. 5A by the phantom line. Thus, the movable plate 10 is stably supported at the upper limit position with respect to the stationary plate 20. By manually pivoting the stopper 16 in the clockwise direction in FIG. 5, the locked state of the stopper 16 is released.

As shown in FIG. 1, the pivot shaft portions 32 are rotatably supported by upper end portions of the left-side and right-side movable plates 10, respectively, whereby the TLF unit 30 is pivotable about the pivot shaft portions 32 as a pivot axis. Since the TLF unit 30 is pivotable within a range in which the wiring cable connected to the terminal portion 37 does not interfere with one of the pivot shaft portions 32, the TLF unit 30 can pivot in a range of approximately 360°. Further, the TLF unit 30 is pivotable irrespective of at which position the movable plate 10 is located. In FIG. 1B, the movable plate 10 which is slightly inclined frontward at the upper limit position is indicated by the phantom line.

As shown in FIG. 5A, two guide grooves (i.e., a first guide groove 21 as a first guiding portion and a second guide groove 22 as a second guiding portion) are formed through the thickness of the side plate portion 20*b* of the stationary plate 20. Where the side plate portion 20*b* is regarded as a plane, the two guide groove 21, 22 are arranged in a common plane. The engagement pin 11 as a first guided portion is in engagement with the guide groove 21 while the engagement pin 22 as a second guided portion is in engagement with the groove 22. In other words, each of the engagement pins 11, 12 has a neck portion and a head portion. The neck portions of the engagement pins 11, 12 penetrate through the associated guide grooves 21, 22, and the head portions of the same 11, 12 protrude outward such that the engagement pins 11, 12 do not come off, as shown in FIG. 3.

The engagement pins 11, 12 are guided by the respective guide grooves 21, 22, whereby the movable plate 10 moves relative to the stationary plate 20. By designing the shapes of the guide grooves 21, 22 as described below, the movement of the movable plate 10 in the up-and-down direction involves a pivotal displacement.

The longitudinal direction of the guide grooves 21, 22 is substantially along the up-and-down direction in which the movable plate 10 moves. That is, the guide groove 21 has a straight portion 21*a* while the guide groove 22 has a straight portion 22*a*. The straight portions 21*a*, 22*a* are parallel to each other in side view. The guide groove 21 further has a curved portion 21*b* which extends upward from the straight portion 21*a* so as to be contiguous thereto. The guide groove 22 further has a curved portion 22*b* which extends upward from the straight portion 22*a* so as to be contiguous thereto. The curved portions 21*b*, 22*b* are curved in opposite directions, and the concave side of the curved portion 21*b* and the concave side of the curved portion 22*b* are opposed to each other. In other words, the convex side of the curved portion 21*b* protrudes frontward in the front-and-back direction while the convex side of the curved portion 22*b* protrudes backward in the front-and-back direction. Each of the straight portions 21*a*, 22*a* extends in a direction parallel to the vertical direction.

The first guide groove 21 is formed at a position which is shifted downward with respect to the second guide groove 22. Here, it is assumed that a phantom straight line L1 exists in the middle between the straight portions 21*a*, 22*a* so as to extend in parallel with the vertical direction, as shown in FIGS. 5B and 5C. Where the first guide groove 21 is translated upward by a suitable distance in parallel with the phantom straight line L1, the curved portion 21*b* of the first guide groove 21 and the curved portion 22*b* of the second guide groove 22 are line symmetric about the phantom straight line L1.

In this arrangement, a movement locus of the middle position between the engagement pin 11 and the engagement pin 12 coincides with the phantom straight line L1 over the entirety of the movement range of the movable plate 10. As described above, since the pinion 13 is located at the middle position between the engagement pin 11 and the engagement pin 12, a movement locus of the pinion 13 coincides with the phantom straight line L1 and is a substantially straight line parallel to the vertical direction. Accordingly, it is possible to employ, as the rack portion 23, an ordinary linear rack, ensuring a simplified structure and high accuracy.

It is not essential that the length of the straight portion 21*a* and the length of the straight portion 22*a* coincide with each other. In the present embodiment, the length of the straight portion 21*a* and the length of the straight portion 22*a* coincide with each other. Accordingly, the guide grooves 21, 22 as a whole have a line symmetric relation about the phantom straight line L1 where the guide grooves 21, 22 are translated in the up-and-down direction relative to each other.

As shown in FIGS. 1A and 3, two magnets 15 are attached to the right end portion of the rail member 14. The magnets 15 move integrally with the movable plate 10, together with the rail member 14. When the magnets 15 are located at a position adjacent to any of the Z-shaped bent members 41, the magnets 15 and the Z-shaped bent member 41 are attracted to each other, so as to stop the movable plate 10 at that position. The Z-shaped bent members 41 are provided at a plurality of positions, whereby the position of the movable plate 10 in the up-and-down direction is stably kept at the plurality of positions within the movement range of the same 10. The mechanism for keeping the position of the movable plate 10 is not limited to the one that utilizes the magnetic force, but may be a fastening mechanism or a sandwiching mechanism.

In the right-side and left-side movement mechanisms M, the shape of the stationary plates 20 and the shapes of the guide grooves 21, 22 are left-right symmetric. Further, the movable plates 10, the stoppers 16, the covers 25, and the engagement pins 11, 12 in the right-side and left-side movement mechanisms M are also left-right symmetric. In the present embodiment, the rack support member 24, the rack portion 23, the pinion 13, the Z-shaped bent members 41, and the magnets 15 are provided only in the right-side movement mechanism M. Those components may be provided in the left-side movement mechanism M so as to be symmetric with respect to the corresponding components in the right-side movement mechanism M.

The stationary plate 20 needs to be fixed to a portion which is stationary with respect to the instrument main body 1, and the base body 40 is not necessarily essential. In the left-side movement mechanism M, the stationary plate 20 is fixed to the instrument main body 1, and accordingly the base body 40 is not provided in the left-side movement mechanism M. However, there may be provided a member corresponding to the base body 40 in the left-side movement mechanism M.

In the arrangement described above, when the movable plate 10 is manually lifted upwards from the initial position, the engagement pins 11, 12 are guided by the corresponding guide grooves 21, 22. In a time period during which the engagement pins 11, 12 are held in engagement with the corresponding straight portions 21*a*, 22*a*, the movable plate 10 linearly moves upward by translation without involving a pivotal displacement. The pinion 13 linearly moves upward while meshing with the rack portion 23. Since the TLF unit 30 is very light-weight, the manual operation for moving the TLF unit 30 is easy. It is noted, however, that an electric moving mechanism may be provided. Further, there may be provided a damper gear which acts on the rotary motion of the pinion 13 so as to generate a suitable sliding resistance. Moreover, there may be provided a shock absorber which acts on the downward movement of the TLF unit 30.

When the engagement pins 11, 12 start to engage the corresponding curved portions 21*b*, 22*b*, the engagement pin 11 moves obliquely backward while the engagement pin 12 moves obliquely frontward, as shown in FIGS. 5B and 5C. The movement amount of the engagement pin 11 in the front-and-back direction and the movement amount of the engagement pin 12 in the front-and-back direction coincide with each other. As a result, the pinion 13 linearly moves upward while meshing with the rack portion 23. The engagement pins 11, 12 pivot counterclockwise in FIG. 5 about the pinion 13, so that the movable plate 10 accordingly pivotally moves and inclines frontward.

Where a user removes his/her hand from the movable plate 10 when the magnets 15 come into close contact with any of the Z-shaped bent members 41 in the movement of the movable plate 10, the movable plate 10 is kept located at the position. Further, in each pivot shaft portion 32, friction is to be generated, whereby the TLF unit 30 is pivoted about the pivot shaft portions 32 to a desired position and is held at that position irrespective of the position of the movable plates 10.

When the engagement pins 11, 12 reach the upper ends of the respective curved portions 21*b*, 22*b*, the stopper 16 pivots counterclockwise and is restricted so as to be located at the prescribed position. When the user removes his/her hand from the movable plate 10, the stopper 16 engages the upper end of the cover 25, namely, the stopper 16 is placed in the locked state, so that the movable plate 10 is stably held at the upper limit position. As shown in FIG. 1B, the height position of a top end of the movable plate 10 (i.e., the height position of the pivot shaft portion 32) at the initial position is sufficiently lower than an average height H (standard height) of the position of the head (ears) of the player. The height position of the top end of the movable plate 10 (i.e., the height position of the pivot shaft portion 32) at the upper limit position is sufficiently higher than the height H. Further, as shown in FIG. 1B, the movable plate 10 is located more frontward in the front-and-back direction of the electronic musical instrument when the movable plate 10 is located at a height position which is higher than the position of the head of the player that corresponds to the upper limit position than when the movable plate 10 is located at a height position which is lower than the position of the head of the player that corresponds to the initial position. More specifically, when the movable plate 10 is located at the initial position, the movable plate 10 is located more backward than the rear end portion of the keyboard portion KB in the front-and-back direction. When the movable plate 10 is located at the upper limit position, at least the upper end portion of the movable plate 10 at which the pivot shaft portion 32 is provided is located more frontward than the rear end portion of the keyboard portion KB in the front-and-back direction. In this arrangement, the sound source can be made closer to the player.

While not shown, the present electronic musical instrument includes: a sound source circuit for converting performance data inputted in the keyboard portion KB and pre-set performance data, etc., into musical sound signals; and an effect circuit for giving various effects to musical sound signals. The musical sound signals are sent to both of the cone speakers 42 and the electrostatic speaker 31. However, the signals may be separated, and only musical sound signals in the middle and treble ranges may be converted into sounds in the electrostatic speaker 31. The electrostatic speaker 31 not only brings about changes in the acoustics or sounds, but also is suitable for assisting and monitoring the acoustics or sounds in the middle and treble ranges.

According to the present embodiment, the position and the posture of the electrostatic speaker 31 with respect to the instrument main body 1 are variable. The sounds of the electrostatic speaker 31 are basically felt not as point sound source but as broad surface sound source, and such sounds are generated at a desired position, so that it is possible to vary the perception of the position of the sound generation source and the sense of sound spread and to variously change the acoustics (sounds) felt by the player. Where the height position of the electrostatic speaker 31 is made higher than the height H of the position of the player's head, for instance, the sound generation source is felt to be located above the head, so that the sounds can be heard from positions not in conventional keyboard musical instruments, namely, the sounds can be heard as if the sounds fall from above.

Further, the TLF unit 30 has strong directivity. Accordingly, where the TLF unit 30 is oriented to a desired direction by pivoting, the sound transmission direction is made variable. Therefore, it is possible to provide mainly the middle and treble ranges in the desired direction. In addition, the acoustics or sounds for the player largely change. Where the TLF unit 30 is oriented directly to the player, for instance, the sense of sound spread is enlarged in the up-and-down direction, together with the cone speakers 42. Alternatively, it is possible to permit the sounds to be reflected on room walls, such that the sounds reach the player. Therefore, the sound directivity is made variable in the up-and-down direction, and it is possible to realize various changes in the acoustics by utilizing reflection of the sounds on the room walls, a ceiling, etc. Moreover, the electrostatic speaker 31 is disposed so as to extend over the entire width of the keyboard portion, whereby the sound generation source can be felt widely in the lateral or width direction.

According to the present embodiment, the guide grooves 21, 22 respectively have the curved portions 21*b*, 22*b* at the upper portions thereof as seen from the direction perpendicular to the common plane (as seen from the side of the musical instrument), whereby the pivot displacement of the movable plate 10 can be caused at the last stage of the upward movement. In particular, since the concave side of the curved portion 21*b* and the concave side of the curved portion 22*b* are opposed to each other, it is possible to cause a large pivotal displacement of the movable plate 10 by a small moving distance or stroke of the movable plate 10 and to ensure space saving in the direction in which the guide grooves 21, 22 are arranged, namely, in the front-and-back direction of the musical instrument.

Further, where the curved portions 21*b*, 22*b* are translated relative to each other in the up-and-down direction, the curved portions 21*b*, 22*b* are line symmetric about the phantom straight line L1, whereby the movement locus of the pinion 13 which is the pivot center of the movable plate 10 can be made linear. Accordingly, an ordinary linear rack can be utilized as the rack portion 23, contributing to simplification of the structure and cost reduction.

The shapes and the regions of the curved portions 21*b*, 22*b* are not limited to the illustrated ones, from a viewpoint that a combination of the curved shape of the guide groove 21 and the curved shape of the guide groove 22 enables a design in which a desired pivotal displacement of the movable plate 10 is caused in the movement of the movable plate 10. For instance, at least a part of one of the first and second guide grooves 21, 22 may be curved, or at least a part of the first guide groove 21 and at least a part of the second guide groove 22 may be curved in mutually different directions or may be curved in mutually different curvatures. For instance, the guide grooves 21, 22 may be curved in directions opposite to the illustrated ones when a particular emphasis is placed only on generating a large pivotal displacement of the movable plate 10.

In the present embodiment, the electrostatic speaker 31 is disposed to assume a flat posture in the TLF unit 30. By taking advantage of flexibility and the pliability, the electrostatic speaker 31 may be disposed in a curved posture as shown in modified embodiments of FIG. 6.

Figure 6A:
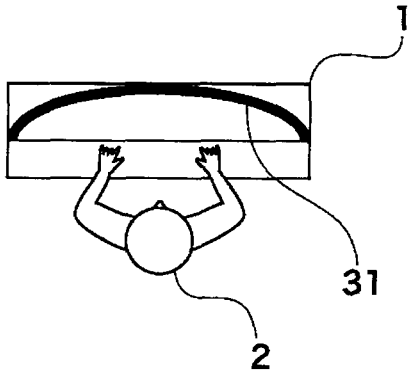
FIGS. 6A and 6B are schematic views each showing a curved TLF unit and FIG. 6C is a perspective view showing a simple example of a mechanism for curving the TLF unit.
Figure 6B:
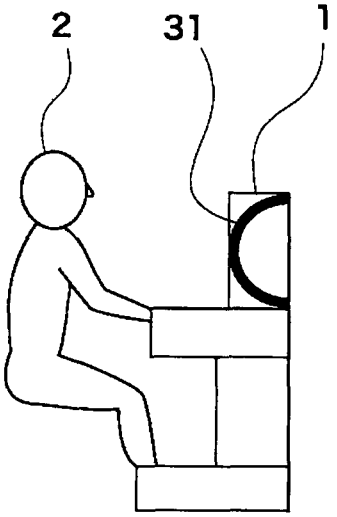
Figure 6C:
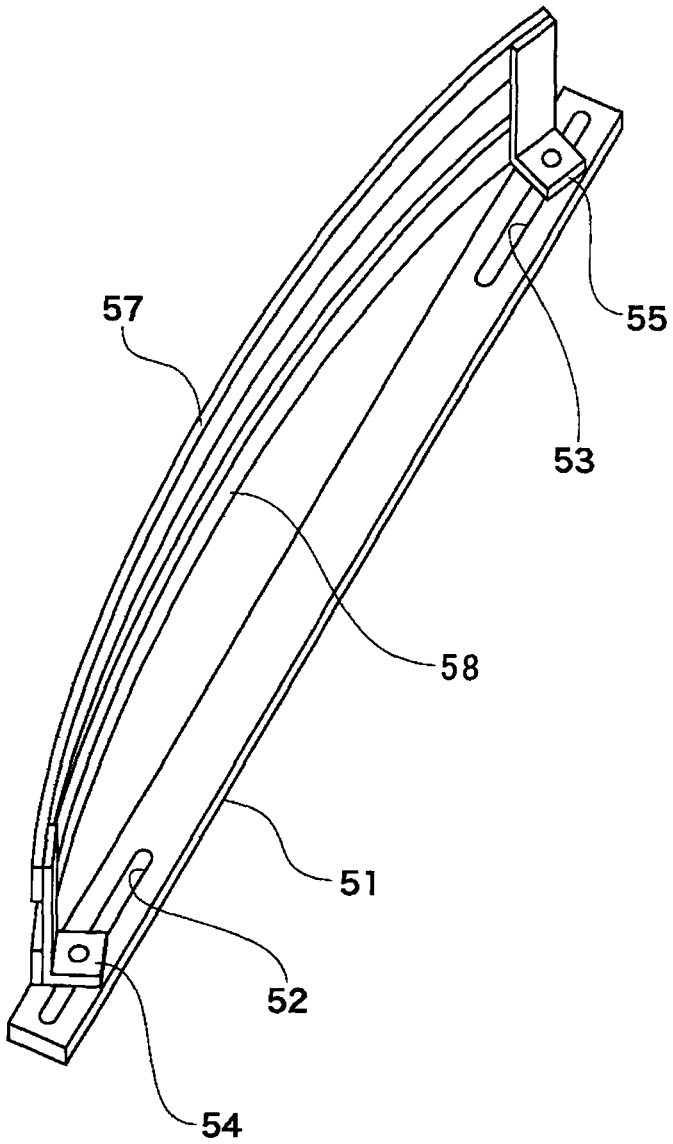

FIGS. 6A and 6B are schematic views each showing a curved TLF unit 30 and FIG. 6C is a perspective view showing a simple example of a mechanism for curving the TLF unit 30.

In the modified embodiments of FIG. 6, the entirety of the TLF unit 30 including the electrostatic speaker 31 or the electrostatic speaker 31 per se is curved and is disposed in the instrument main body 1. As shown in FIG. 6A, where the electrostatic speaker 31 is curved in the left-and-right direction so as to be convex backward, the sound pressure with respect to a player 2 becomes high. As shown in FIG. 6B, where the electrostatic speaker 31 is curved in the up-and-down direction so as to be convex frontward, the sound directivity direction is enlarged in the up-and-down direction though the sound pressure with respect to the player 2 becomes low. By varying the curved state, the acoustics or sounds felt by the player can be changed more diversely.

It is preferable to provide a mechanism for maintaining the curved state of the TLF unit 30 or the electrostatic speaker 31. For instance, groove portions 52, 53 are formed at both ends of a base 51, as shown in FIG. 6C. Further, longitudinally opposite ends of each of two plate members 57, 58 which have flexibility and to which the electrostatic speaker 31 is fixed are attached to a stay 54 and a stay 55, whereby the periphery of the electrostatic speaker 31 is fixed by the plate members 57, 58 and the stays 54, 55. The longitudinal direction of the plate member 57, 58 corresponds to the longitudinal direction of the electrostatic speaker 31 (the left-and-right direction of the instrument main body 1).

The stays 54, 55 are fastened at suitable positions of the respective groove portions 52, 53 using screws while the plate members 57, 58 are curved. It is possible to adjust the curvature of the plate members 57, 58 to a desirable degree depending upon the fastening positions of the stays 54, 55 with respect to the groove portions 52, 53. Since the degree of curving is variable, the sound pressure distribution based on the orientation of the electrostatic speaker 31 is made adjustable. The electrostatic speaker 31 fixed to the plate members 57, 58 is curved in accordance with the curving of the plate members 57, 58 and is kept in the curved state. It is noted that the arrangement shown in FIG. 6C is one example. The direction of curving may be the up-and-down direction. Further, the mechanism for maintaining the curved state is not limited to the illustrated one. Moreover, only the electrostatic speaker 31 may be curved within members which hold the electrostatic speaker 31.

In the illustrated embodiment, the movement structure of the movable portion (the movement mechanism M) is applied to the TLF unit 30 in the electronic musical instrument. The movement mechanism M may be applied otherwise. For instance, the movement mechanism M is applicable to various elements such as a keyboard lid which will be explained with reference to FIG. 7 and a music rest of a music stand device.

Figure 7A:
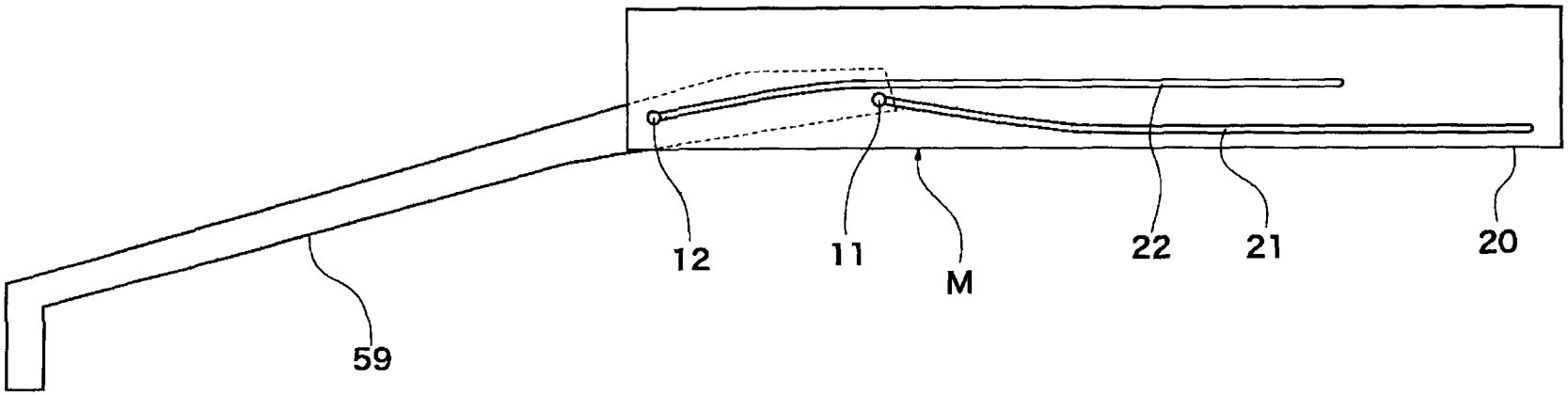
FIGS. 7A and 7B are schematic views showing an example in which a movement mechanism is applied to a keyboard lid of a keyboard musical instrument.
Figure 7B:
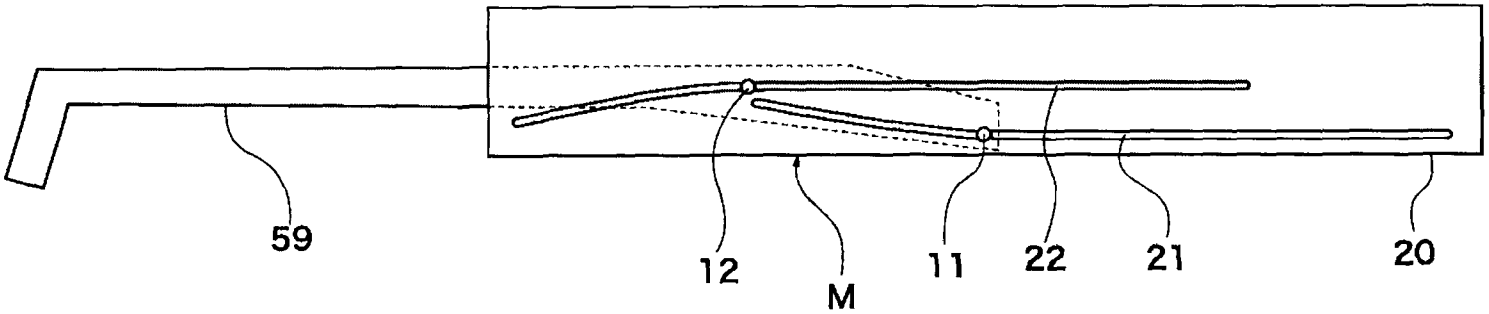

FIGS. 7A and 7B are schematic views showing an example in which the movement mechanism M is applied to a keyboard lid of a keyboard musical instrument. FIG. 7A shows a lid-closed state in which the keyboard lid is closed, and FIG. 7B shows a state in which the keyboard lid is between a lid-open state and the lid-closed state.

The arrangement shown in FIGS. 7A and 7B corresponds to an arrangement in which the TLF unit 30 is eliminated and a keyboard lid 59 is movably provided in place of the movable plate 10, in the arrangement shown in FIGS. 1-6. The pinion and the rack are not illustrated.

In the arrangement shown in FIGS. 7A and 7B, where the keyboard lid 59 is pulled frontward, namely, pulled leftward in FIG. 7, the keyboard lid 59 initially moves horizontally. Thereafter, owing to the guide grooves 21, 22, the keyboard lid 59 undergoes a pivotal displacement in the counterclockwise direction in FIGS. 7A and 7B at the final stage of its movement and is finally placed in the lid-closed state.

In the illustrated embodiments, the guide grooves 21, 22 are in the form of through-holes formed through the thickness of the stationary plate 20. The guide grooves 21, 22 may be formed otherwise. For instance, each guide groove 21, 22 may be in the form of a recess or a rail. While the rack teeth 23*a* shown in FIG. 3 are oriented backward, the rack teeth 23*a* may be oriented leftward, rightward, or frontward, and the pinion 13 may be disposed in accordance with the orientation of the rack teeth 23*a*.

For causing the pivotal displacement of the movable plate 10, the guide grooves 21, 22 are essential, and the rack portion 23 and the pinion 13 are not essential. The guided portions which are held in engagement with the guide grooves 21, 22 so as to be guided by the guide grooves 21, 22 are not limited to pin-like members such as the engagement pins 11, 12 illustrated above.

The manner of changing the position and the posture of the movable plate 10 illustrated above is one example, and the pivotal direction, the sliding direction, the curving direction may be variously combined. Further, there may be provided a reflective plate for reflecting sounds of the TLF unit 30. In this instance, the reflective plate per se may be pivotally displaceable.

The TLF unit 30 need not be formed integrally with the instrument main body 1, but may be separately formed so as to be electrically and physically connectable to the instrument main body 1.

That is, the stationary plate 20 is attachable to and detachable from the instrument main body 1, but the movable plate 10 may be configured to move while being supported by the instrument main body 1. Accordingly, the stationary portion by which the movable plate 10 is movably supported may be a portion fixed to the instrument main body 1 (including the instrument main body 1 per se) or may be an attachable member which is attachable to the instrument main body 1. In other words, the attachable member which is attachable to the instrument main body 1 may be formed separately from the instrument main body 1. In this instance, it is preferable that the attachable member be electrically connectable to the instrument main body 1 for sound generation to allow transmission of signals therebetween, whereby the TLF unit 30 as the speaker unit for the musical instrument can generate musical sounds based on the performance operation in the instrument main body 1, irrespective of whether the TLF unit 30 is physically integral with or separate from the instrument main body 1. The above-indicated attachable member may be a large-sized member that can hold the instrument main body 1, and the instrument main body 1 may be held by the attachable member laid on a floor surface.

When focusing only on the viewpoint that the position and the posture of the TLF unit 30 are made variable, the musical instrument to which the TLF unit 30 is applied is not limited to the keyboard musical instrument. Further, the musical instrument to which the movement structure of the movable portion (the movement mechanism M) is applied is not limited to the electronic keyboard musical instrument, but may be applied to an acoustic musical instrument. The musical instrument need not be the keyboard musical instrument.

There will be next explained a second embodiment of the invention with reference to the drawings.

Figure 8A:
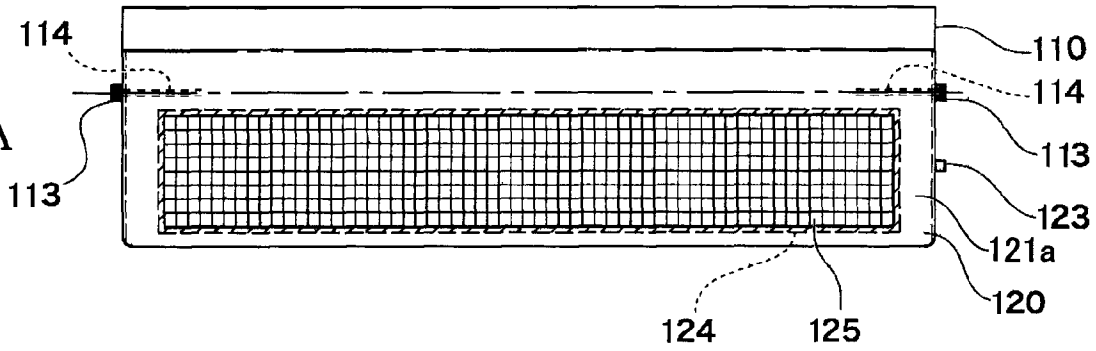
FIGS. 8A, 8B, and 8C are a top view, a front view, and a right side view, respectively, of an electronic keyboard musical instrument according to a second embodiment of the invention with its keyboard lid in a closed state.
Figure 8C:
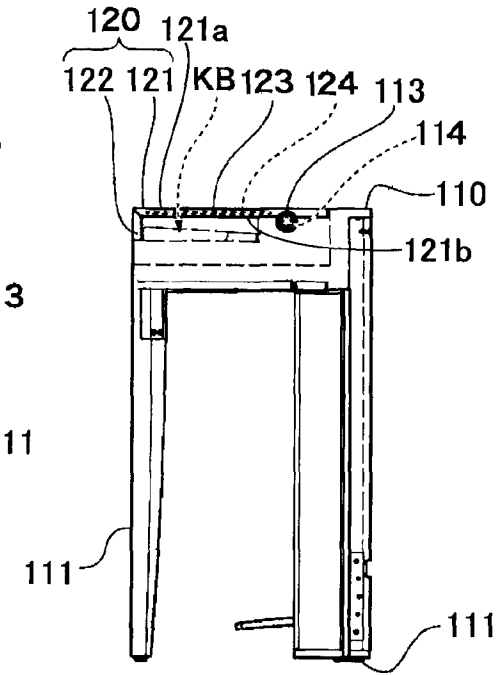
Figure 8B:
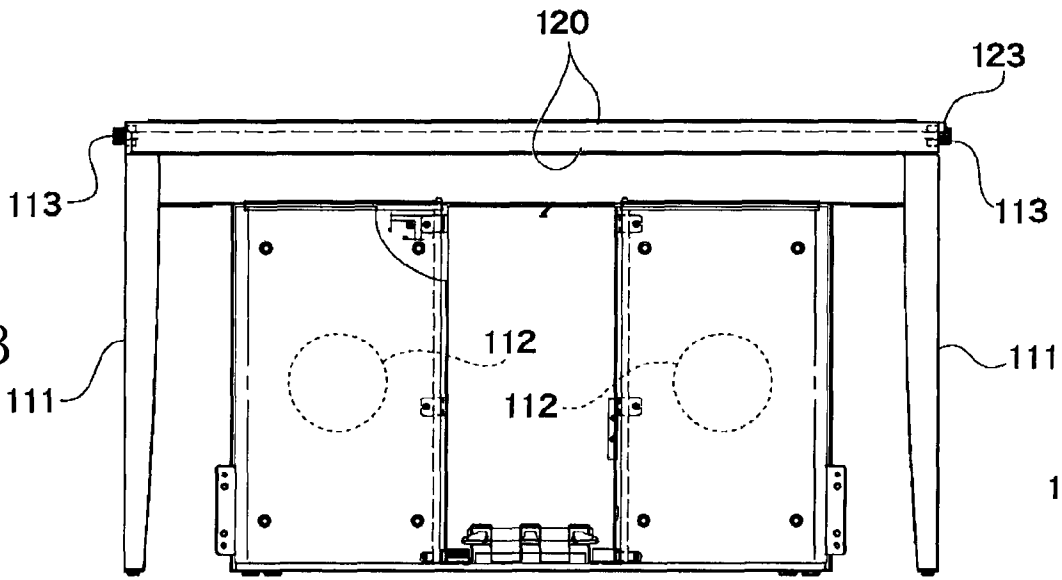
Figure 9B:
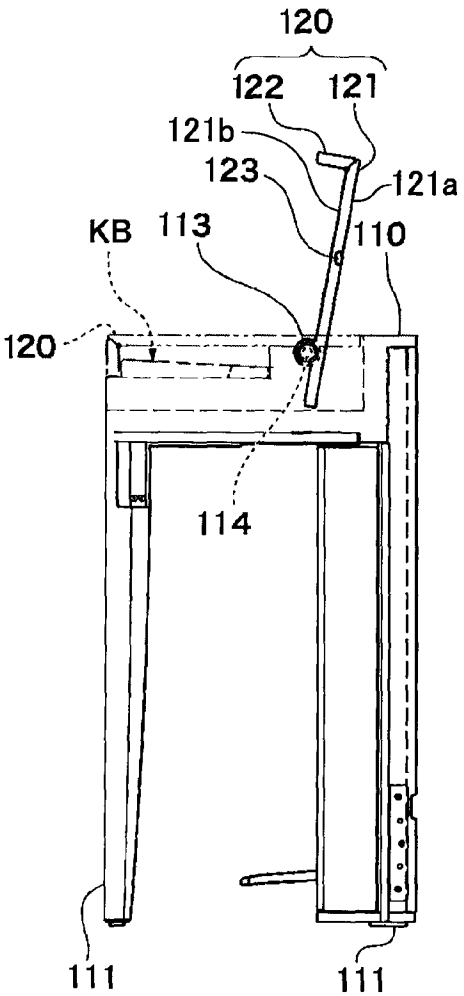
FIGS. 9A and 9B are a front view and a right side view, respectively, of the electronic keyboard musical instrument with its keyboard lid in an open state.
Figure 9A:
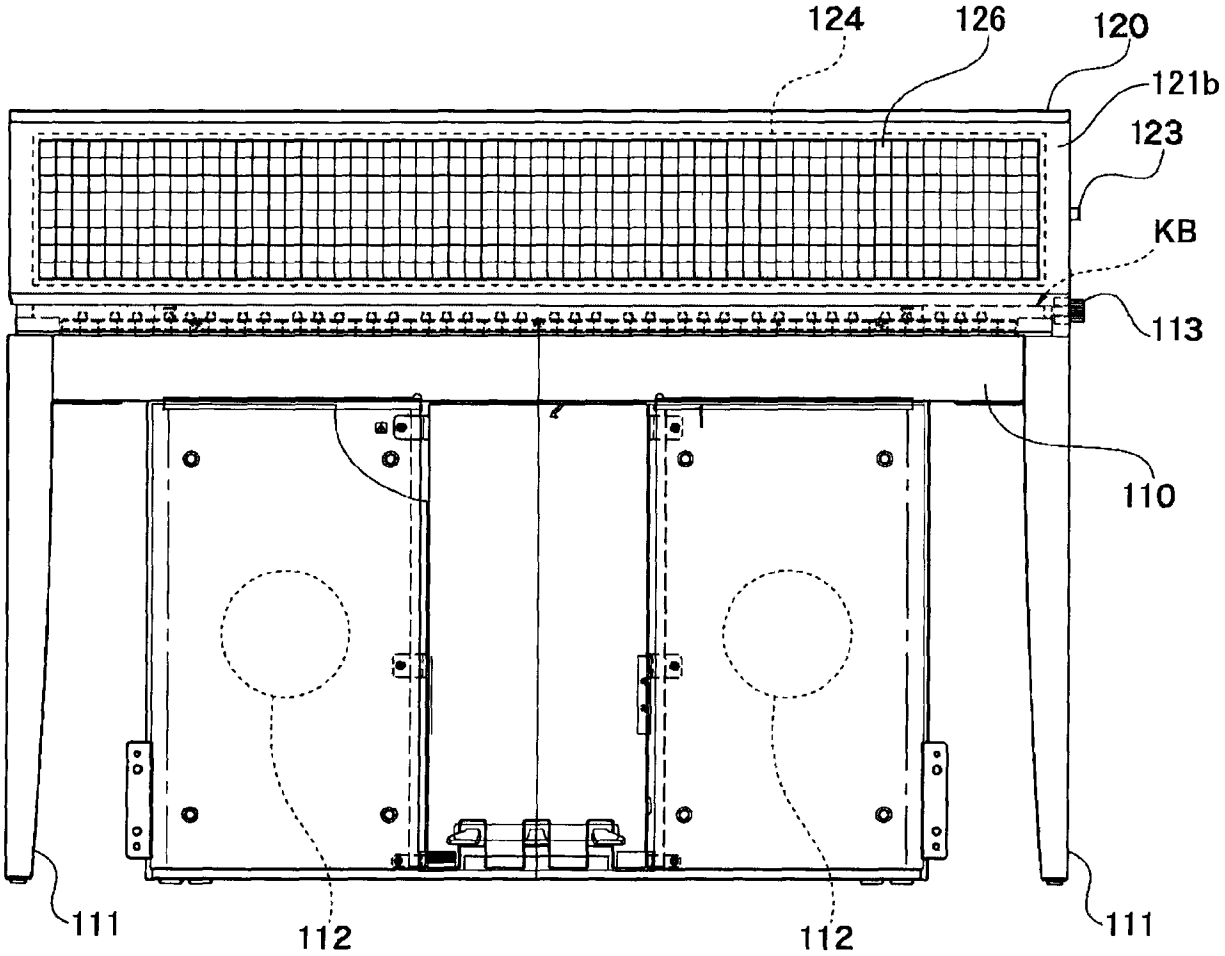

FIGS. 8A, 8B, and 8C are a top view, a front view, and a right side view, respectively, of an electronic keyboard musical instrument according to the second embodiment of the invention with its keyboard lid in a closed state. FIGS. 9A and 9B are a front view and a right side view, respectively, of the electronic keyboard musical instrument with its keyboard lid in an open state. As in the illustrated first embodiment, in the following explanation, the terms "up-and-down direction" and "left-and-right direction" are used based on the up-and-down direction and the left-and-right direction in FIG. 8B. As for the term "front-and-rear direction", the side on which the player of the electronic keyboard musical instrument is situated, namely, the front side of the electronic keyboard musical instrument as seen in FIG. 8B, is referred to as "front".

As shown in FIGS. 8 and 9, the electronic keyboard musical instrument according to the present embodiment has a keyboard portion KB disposed in an instrument main body 110 which is supported by leg portions 111, and a pair of left and right cone speakers 112 are provided below the keyboard portion KB. In the instrument main body 110, there is disposed a keyboard lid 120 configured to pivot so as to be opened and closed. The keyboard lid 120 as one example of the stationary portion is configured to pivot about pivot shaft portions 114 relative to the instrument main body 110, so as to be placed selectively in: a closed state (lid-closed state) in which the keyboard lid 120 covers the keyboard portion KB; and an open state (lid-open state) in which the keyboard lid 120 is opened so as to uncover the keyboard portion KB such that the keyboard portion is operable for performance. The keyboard lid 120 is constituted by a main portion 121 which is located above the keyboard portion KB when the keyboard lid 120 is in the closed state; and a front portion 122 which is located frontward of the keyboard portion KB when the keyboard lid 120 is in the closed state.

At a left side portion and a right side portion of the main portion 121 which are located on the axis of the pivot shaft portions 114, adjustment portions 113 are provided so as to protrude from the left side portion and the right side portion of the main portion 121, respectively. By changing the degree of fastening of the adjustment portions 113, it is possible to adjust a load on the pivotal motion of the keyboard lid 120 about the pivot shaft portions 114. The adjustment can be made irrespective of at which position within the entire pivotable range the keyboard lid 120 is located. Accordingly, where the adjustment portions 113 are tightly fastened with the keyboard lid 120 located at a desired position within the pivotable range, for instance, the keyboard lid 120 is kept located at that position with high stability. Where the adjustment portions 113 are loosely fastened, the keyboard lid 120 can be manually pivoted to a desired position and can be kept located at that position if the user takes his/her hands off the keyboard lid 120.

In the main portion 121 of the keyboard lid 120, an electrostatic speaker 124 (also called "TLF" (Thin Light Flexible)) is incorporated. The electrostatic speaker 124 is the so-called planar speaker which is thin and light-weight and which has pliability and flexibility. The planar speaker 124 has a known structure disclosed in JP-A-2010-68053, for instance.

Roughly, the electrostatic speaker 124 is constituted by two electrodes which are opposed to each other with a spacing interposed therebetween and a sheet-like oscillating member having electric conductivity and interposed between the two electrodes. When a voltage applied to the electrodes is changed in a state in which a suitable bias voltage is applied to the oscillating member, an electrostatic force that acts on the oscillating member is changed, whereby the oscillating member is displaced. By changing the application voltage in accordance with acoustic signals to be inputted, the oscillating member is repeatedly displaced, namely, the oscillating member oscillates, so that reproduced waves in accordance with the acoustic signals are generated from the oscillating member.

Since the electrostatic speaker is inferior in acoustic characteristics in the bass range, in general, the electrostatic speaker is not employed positively as a main speaker in electronic keyboard musical instruments. The electrostatic speaker, however, has characteristics that a cone speaker does not have.

For instance, in the electrostatic speaker, the larger the area of a planar plate of the electrostatic speaker, the stronger the sound directivity in a direction perpendicular to the planar plate. Consequently, the electrostatic speaker offers the property ensuring that sounds reach far. Further, in the electrostatic speaker, the sounds can be emitted from both surfaces thereof. In particular, a thin and flexible electrostatic speaker is small in size and light in weight, and has flexibility that enables the electrostatic speaker to be curved or twisted, ensuring a freedom in shape.

In the present embodiment, therefore, the electrostatic speaker 124 is disposed in the keyboard lid 120, and the orientation of the electrostatic speaker 124 is made variable. The electrostatic speaker 124 is disposed so as to extend over the entire width of the keyboard portion KB. The keyboard lid 120 and the electrostatic speaker 124 constitute a speaker unit.

Figure 10A:
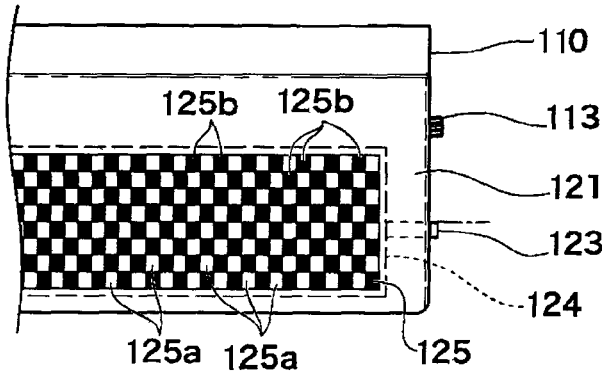
FIGS. 10A and 10B are top views of a right end portion of the electronic keyboard musical instrument with its keyboard lid in the closed state and FIG. 10C is a right side view of an upper portion of the electronic keyboard musical instrument with its keyboard lid in the closed state.
Figure 10B:
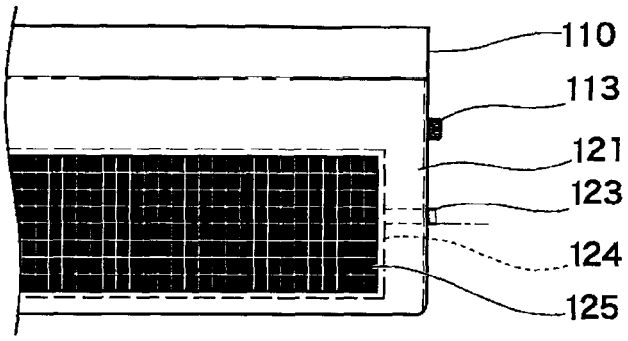
Figure 10C:
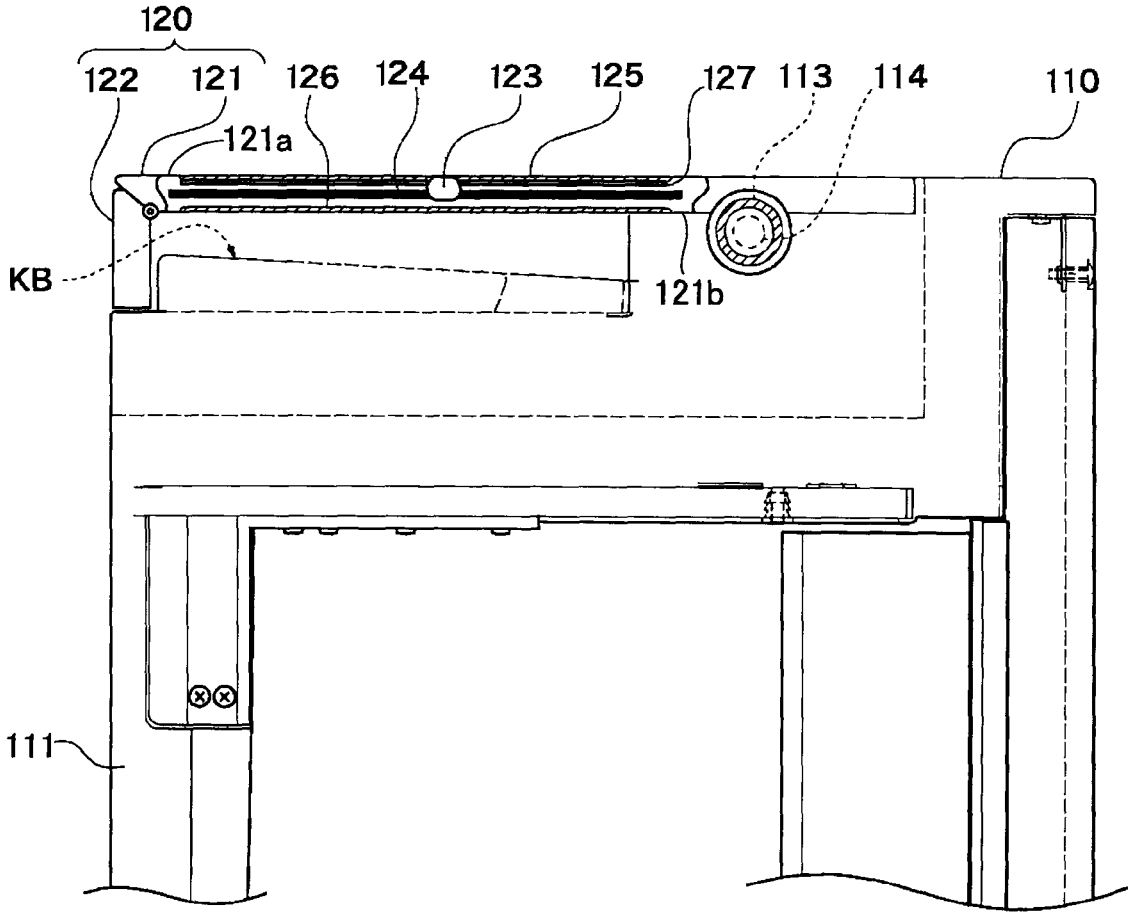

FIGS. 10A and 10B are top views of a right end portion of the electronic keyboard musical instrument with its keyboard lid 120 in the closed state and FIG. 10C is a right side view of an upper portion of the electronic keyboard musical instrument with a part of the keyboard lid 120 illustrated in cross section. In the following explanation, one of opposite surfaces of the main portion 121 of the keyboard lid 120 which is exposed to an exterior in the lid-closed state is referred to as "upper surface 121*a*", and the other of the opposite surfaces of the main portion 121 of the keyboard lid 120 which is opposed to the keyboard portion in the lid-closed state is referred to as "lower surface 121*b*". That is, the upper surface 121*a* as a first surface and the lower surface 121*b* as a second surface also refer to an upper surface and a lower surface of the keyboard lid 120, respectively, in a state in which the keyboard lid 120 is closed.

As shown in FIG. 10C, an upper-surface-side plate member 125 is provided so as to be flush with the upper surface 121*a* of the main portion 121 while a lower-surface-side plate member 126 is provided so as to be flush with the lower surface of the main portion 121. As shown in FIG. 10A, the upper-surface-side plate member 125 is formed of a punching metal or a mesh member in which a multiplicity of sound emission openings 125*a* are formed. In the upper-surface-side plate member 125, the sound emission openings 125*a* and non-opening portions 125*b* are alternately arranged in the left-and-right direction and the front-and-back direction so as to provide a lattice pattern. The lower-surface-side plate member 126 is similarly constituted.

The electrostatic speaker 124 is disposed between the upper-surface-side plate member 125 and the lower-surface-side plate member 126. Between the upper-surface-side plate member 125 and the electrostatic speaker 124, a shutter member 127 is disposed so as to be in contact with the upper-surface-side plate member 125. The upper-surface-side plate member 125, the lower-surface-side plate member 126, the electrostatic speaker 124, and the shutter member 127 are parallel to one another.

The shutter member 127 is configured to be slidable in the front-and-back direction or the left-and-right direction. By manually operating a knob 123, the shutter member 127 moves in the front-and-back direction, for instance. In the shutter member 127, sound emission openings and non-opening portions similar to the sound emission openings 125*a* and the non-opening portion 125*b* are formed in the similar pattern. By manually operating the knob 123, the shutter member 127 is movable between a forward position and a backward position.

When the shutter member 127 is moved to the forward position, the sound emission openings and the non-opening portions of the shutter member 127 are aligned with the sound emission openings 125*a* and the non-opening portions 125*b* of the upper-surface-side plate member 125, as shown in FIG. 10A. In this case, the sound emission openings 125*a* are opened, so that the sounds generated by the electrostatic speaker 124 are emitted to the upper-surface side through the sound emission openings of the shutter member 127 and the sound emission openings 125*a* of the upper-surface-side plate member 125. On the other hand, when the shutter member 127 is moved to the backward position, the sound emission openings of the shutter member 127 are aligned with the non-opening portions 125*b* of the upper-surface-side plate member 125, as shown in FIG. 10B). In this case, the sound emission openings 125*a* are closed, so that the sounds generated by the electrostatic speaker 124 are blocked. The position of the shutter member 127 can be changed as described above irrespective of at which position within the pivotable range the keyboard lid 120 is located.

The lower-surface-side plate member 126 is not provided with the shutter member described above, so that the sounds generated by the electrostatic speaker 124 are always emitted. Accordingly, where the keyboard lid 120 is opened and the shutter member 127 is moved to the forward position (for opening the sound openings 125*a*), the sounds can be emitted simultaneously from both of the upper surface 121*a* and the lower surface 121*b* of the main portion 121 of the keyboard lid 120, namely, from both surfaces of the keyboard lid 120.

It is noted, however, that the shutter member 127 may be provided on both of the upper surface 121*a* and the lower surface 121*b* of the keyboard lid 120 or may be provided only on the lower surface 121*b*. Where the shutter member 127 is provided on each of the upper surface 121*a* and the lower surface 121*b*, the musical instrument may be used in the following manner. That is, in the lid-closed state, the shutter member provided on the lower surface 121*b* is closed while the shutter member provided on the upper surface 121*a* is opened. In this case, sounds are not emitted from the lower surface 121*b* while sounds are emitted from the upper surface 121*a*. In the lid-open state, on the other hand, the shutter member provided on the lower surface 121*b* is opened while the shutter member provided on the upper surface 121*a* is closed. In this case, sounds are emitted from the lower surface 121*b* while sounds are not emitted from the upper surface 121*a*. In this respect, where the electronic keyboard musical instrument is equipped with a mechanism for permitting the shutter member provided on the upper surface 121*a* to be opened in conjunction with closing of the shutter member provided on the lower surface 121*b*, the electronic keyboard musical instrument is used suitably in the manner described above. The sound emission openings 125*a* may be opened and closed by a mechanism other than the mechanism configured to be slidingly movable, like the illustrated shutter member 127. The upper surface 121*a* of the keyboard lid 120 may be configured not to have the sound emission openings 125*a*, and the sounds may be emitted only from the lower surface 121*b*. The sound emission openings may be formed directly in the main portion 121 without providing the upper-surface-side plate member 125 or the lower-surface-side plate member 126.

While not shown, the present electronic keyboard musical instrument includes: a sound source circuit for converting performance data inputted in the keyboard portion KB and pre-set performance data, etc., into musical sound signals; and an effect circuit for giving various effects to musical sound signals. The musical sound signals are sent to both of the cone speakers 112 and the electrostatic speaker 124. However, the signals may be separated, and only musical sound signals in the middle and treble ranges may be converted into sounds in the electrostatic speaker 124. The electrostatic speaker 124 not only brings about changes in the acoustics or sounds, but also is suitable for assisting and monitoring the acoustics or sounds in the middle and treble ranges.

According to the present embodiment, the thin and light-weight electrostatic speaker 124 is incorporated in the keyboard lid 120, whereby musical sounds can be generated from the keyboard lid 120 while suppressing an increase in the thickness and the weight of the keyboard lid 120. The opening and closing operations of the keyboard lid 120 do not give a large load to the user. Since the electrostatic speaker 124 is disposed so as to extend over the entire width of the keyboard portion KB, the sound generation source can be felt widely in the lateral or width direction. For instance, even when the player moves his/her head leftward and rightward, the sounds can be always heard from the proximity of the player. In particular, the electrostatic speaker 124 is the so-called surface sound source and gives the player the acoustics or sounds different from those of the point sound source like the cone speaker. Therefore, the acoustics felt by the player such as the perception of the position of the sound generation source and the sense of sound spread can be made different from just the sort of acoustics expected from electronic musical instruments.

Since the adjustment portions 113 function as a position keeping device configured to keep the keyboard lid 120 at any desired position within the pivotable range of the keyboard lid 120, the sound directivity can be adjusted on the basis of the position of the keyboard lid 120 kept by the adjustment portions 113, thereby making the sense of sound spread variable and diversely changing the acoustics or sounds felt by the player. The structure of the position keeping device is not limited to the adjustment portions 113, but may be a stopper or the like configured to stop the keyboard lid 120 stepwise at different positions.

Since the sounds can be emitted from both of the upper surface 121*a* and the lower surface 121*b* of the main portion 121 of the keyboard lid 120, it is possible to generate musical sounds even in the lid-closed state. This arrangement is suitable for automatic performance or the like based on performance data, not for performance by the player.

On the upper surface 121*a* of the main portion 121 of the keyboard lid 120, the shutter member 127 is provided which is configured to be movable for opening and closing the plurality of sound emission openings 125*a*. Accordingly, the sounds from the electrostatic speaker 124 can be blocked so as not to be emitted from the upper surface side of the keyboard lid 120 when desired.

In the present embodiment, the keyboard lid 120 is pivoted about the pivot shaft portions 114, whereby the electrostatic speaker 124 is pivoted about the pivot shaft portions 114 integrally with the keyboard lid 120. As the structure for making the angle and the posture of the electrostatic speaker 124 variable, there may be employed a structure shown in a modified embodiment of FIG. 11.

Figure 11B:
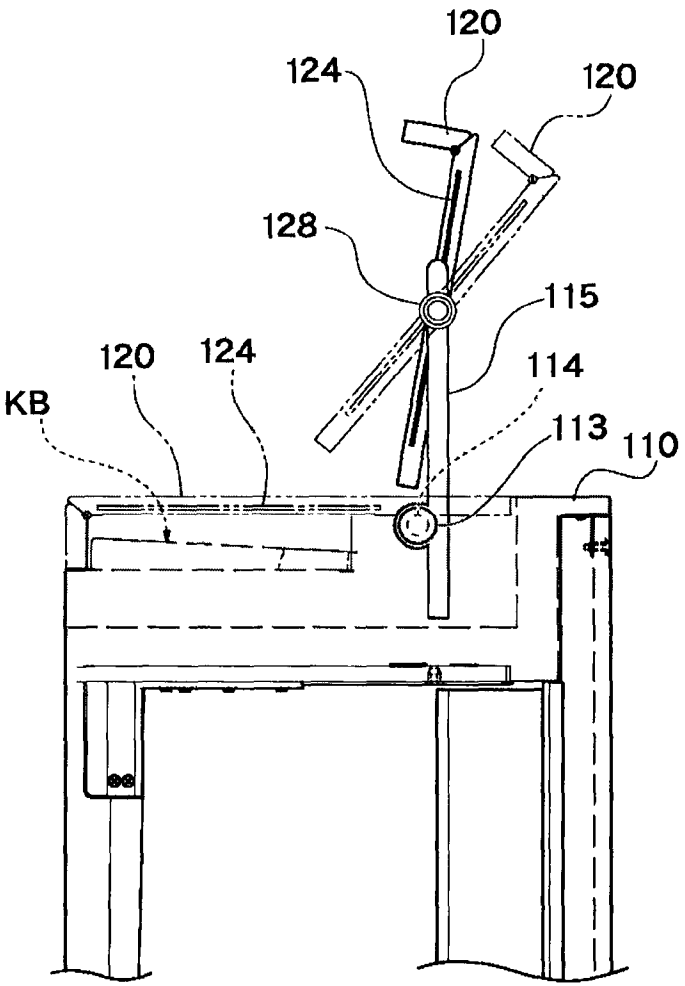
FIGS. 11A and 11B are a front view and a right side view, respectively, of a right-side upper portion of an electronic keyboard musical instrument employing a keyboard lid according to a modified embodiment, the keyboard lid being in an open state.
Figure 11A:
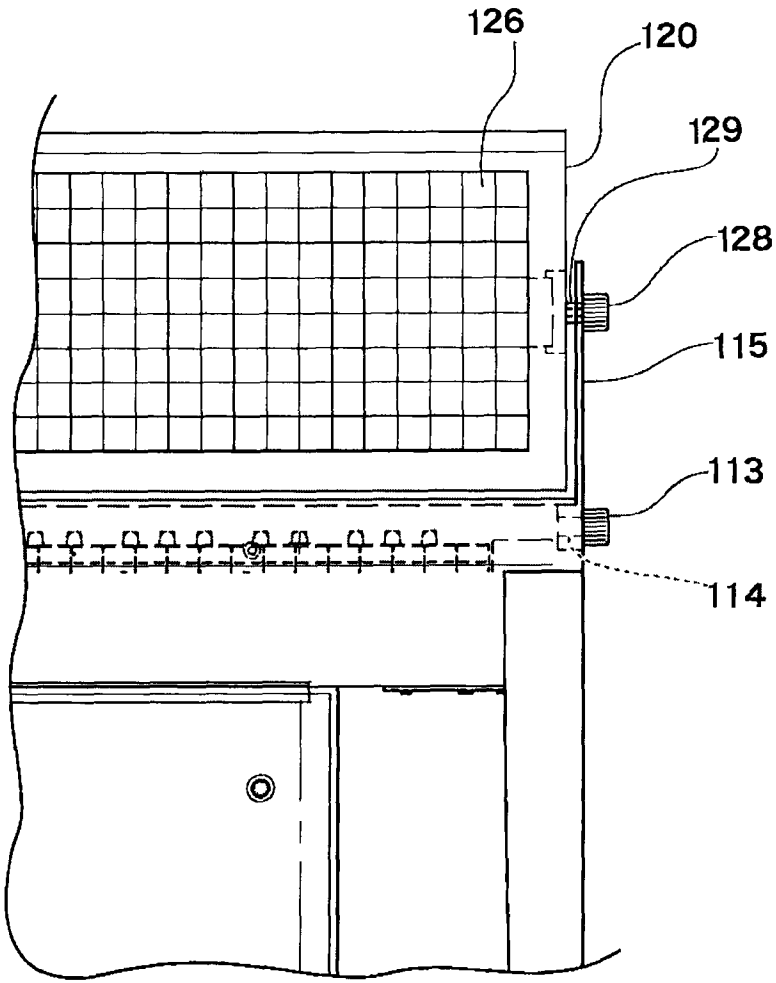

FIGS. 11A and 11B are a front view and a right side view, respectively, of an upper portion on the right side of an electronic keyboard musical instrument which employs a keyboard lid 120 according to the modified embodiment, the keyboard lid 120 being in an open state.

As shown in FIGS. 11A and 11B, a pair of left and right pivot members 115 are provided in an instrument main body 110 so as to pivotable about the pivot shaft portions 114. (Only the right pivot member 115 is shown in FIG. 11.) By changing the degree of fastening the adjustment portions 113, it is possible to adjust a load on the pivotal motions of the pivot members 115 about the pivot shaft portions 114. The keyboard lid 120 is disposed at upper end portions of the pivot members 115 so as to pivotable about pivot shaft portions 129. The pivot shaft portions 129 are parallel to the left-and-right direction (i.e., the key arrangement direction).

At a left side portion and a right side portion of the main portion 121 which are located on the axis of the pivot shaft portions 129, adjustment portions 128 similar to the adjustment portions 113 are provided so as to protrude from the left side portion an the right side portion of the main portion 121, respectively. By changing the degree of fastening the adjustment portions 128, it is possible to adjust a load on the pivotal motion of the keyboard lid 120 about the pivot shaft portions 129 with respect to the pivotal members 115.

While detailed illustration is omitted, the structures of the upper-surface-side plate member 125, the lower-surface-side plate member 126, the electrostatic speaker 124, and the shutter member 127 are identical to those shown in FIGS. 8-10.

According to the modified embodiment of FIG. 11, the pivot members 115 are relatively pivotable with respect to the instrument main body 110, and the keyboard lid 120 is relatively pivotable with respect to the pivot members 115. Therefore, the keyboard lid 120 is configured to be pivotally moved with respect to the instrument main body 110 by the pivot mechanisms in two-steps. In addition, by the fastening operations of the adjustment portions 113, 128, the keyboard lid 120 can be kept located at an arbitrary desired position within each of the two-step pivotable ranges. Accordingly, the keyboard lid 120 can be configured such that not only the angle, but also the position of the pivot center is variable.

In the above arrangement, the posture and the position of the electrostatic speaker 124 are made variable, whereby the position of the sound generation source and the sound directivity can be adjusted. The electrostatic speaker 124 has strong directivity. Accordingly, where the electrostatic speaker 124 is oriented at a desired angle at a desired position, the sound transmission direction is made variable. Therefore, it is possible to provide mainly the middle and treble ranges in a desired direction. In addition, the acoustics or sounds for the player largely change. Where the electrostatic speaker 124 is oriented directly to the player, for instance, the sense of sound spread is enlarged in the up-and-down direction, together with the cone speakers 42. Alternatively, it is possible to permit the sounds to be reflected on room walls, such that the sounds reach the player. Therefore, the sound directivity is made variable in the up-and-down direction, and it is possible to realize diverse changes in the acoustics by utilizing reflection of the sounds on room walls, a ceiling, etc.

In the modified embodiment of FIG. 11, the posture of the keyboard lid 120 is made variable with respect to the instrument main body 110 by the pivot mechanisms in two-steps, together with the electrostatic speaker 124. The mechanism for pivoting may be otherwise arranged. For instance, the electrostatic speaker 124 may be configured to relatively pivot with respect to the keyboard lid 120 which pivots by the pivot mechanism in one step shown in FIGS. 8-10, such that the angle of the electrostatic speaker 124 is variable. Alternatively, pivot mechanisms in three or more steps may be provided between the electrostatic speaker 124 and the instrument main body 110, or pivot mechanisms having mutually different axis directions may be provided therebetween.

The pivotal direction of the electrostatic speaker 124, and the position and the posture of the electrostatic speaker 124 that can be set are not limited to those illustrated above.

The electrostatic speaker 124 may be incorporated in a lid of a device other than the keyboard musical instrument. For instance, the electrostatic speaker 124 is applicable to a lid of a casing for a musical instrument such as a guitar.

While the embodiments of the present invention have been explained, it is to be understood that the invention is not limited to the details of the illustrated embodiments, but may include various forms without departing from the spirit of the invention.

What is claimed is:

1. A speaker unit for a musical instrument and configured to generate music sounds based on a performance operation in a main body of the musical instrument, the speaker unit comprising:

an electrostatic speaker; and a stationary portion, which is a portion fixed to or a member attachable the main body of the musical instrument, wherein the stationary portion supports the electrostatic speaker so that at least one of a position or a posture of the electrostatic speaker with respect to the stationary portion is variable, and wherein the electrostatic speaker is supported by the stationary portion so as to be curved, with a degree of curvature being variable.

2. The speaker unit according to claim 1, wherein the electrostatic speaker is supported to be pivotable with respect to the stationary portion.

3. The speaker unit according to claim 1, wherein the electrostatic speaker is supported by the stationary portion so that a position of the electrostatic speaker in an up-and-down direction is variable between a low height position that is lower than a standard height and a high height position that is higher than the standard height, in a state in which the stationary portion is attached to the main body of the keyboard musical instrument.

4. The speaker unit according to claim 3, wherein the electrostatic speaker is located more frontward in a front-and-back direction of the keyboard musical instrument when the electrostatic speaker is located at the high height position than when the electrostatic speaker is located at the low height position.

5. The speaker unit according to claim 4, wherein the electrostatic speaker is located more backward than a rear end portion, in the front and back direction, of a keyboard portion disposed in the main body of the keyboard musical instrument when the electrostatic speaker is located at the low height position, and the electrostatic speaker is located more frontward than the rear end portion when the electrostatic speaker is located at the high height position.

6. The speaker unit according to claim 1, wherein the electrostatic speaker is disposed so as to extend over an entire width of a keyboard portion of a keyboard musical instrument as the musical instrument, in a state in which the stationary portion is attached to the main body of the keyboard musical instrument.

7. The speaker unit according to claim 2, wherein the electrostatic speaker is pivotable about a pivot axis that is parallel to a direction in which keys of a keyboard musical instrument as the musical instrument are arranged, in a state in which the stationary portion is attached to the main body of the keyboard musical instrument.

8. An electronic keyboard musical instrument comprising:

a main body;

a keyboard portion disposed within the main body;

a keyboard lid configured to pivot with respect to the main body by an opening/closing operation so as to be selectively placeable in:

a closed state in which the keyboard lid covers the keyboard portion; and an open state in which the keyboard lid uncovers the keyboard portion to allow access to the keyboard portion for performance; and a speaker unit configured to generate music sounds based on a performance operation in the keyboard, the speaker unit including:

an electrostatic speaker; and a stationary portion, which is a portion fixed or a member attachable to the main body of the musical instrument, wherein the stationary portion supports the electrostatic speaker so that at least one of a position or a posture of the electrostatic speaker with respect to the stationary portion is variable, and wherein the electrostatic speaker is incorporated in the keyboard lid.

9. The electronic keyboard musical instrument according to claim 8, further comprising a position keeping device configured to keep the keyboard lid at at least one position within an entire pivotable range of the keyboard lid.

10. The electronic keyboard musical instrument according to claim 8, further comprising:

a pivot member configured to pivot with respect to the main body, wherein the keyboard lid is pivotally supported by a pivot member configured to pivot with respect to the main body.

11. The electronic keyboard musical instrument according to claim 8, wherein the electrostatic speaker is relatively pivotable with respect to the keyboard lid.

12. The electronic keyboard musical instrument according to claim 8, wherein:

the keyboard lid has a main portion and a front portion, the main portion being located above the keyboard portion while the front portion being located on a front side of the keyboard portion when the keyboard lid is in the closed state, and the electrostatic speaker is disposed in the main portion of the keyboard lid and emits sound from both of a first surface and a second surface of the main portion, the first surface and the second surface being an upper surface and a lower surface of the main portion, respectively, in the closed state of the keyboard lid.

13. The electronic keyboard musical instrument according to claim 8, wherein:

the keyboard lid is formed with a plurality of sound emission openings from which sounds of the electrostatic speaker are emitted, and the keyboard lid has a shutter member configured to move for opening and closing the plurality of sound emission openings.

14. An electronic musical instrument comprising:

a main body;

a speaker unit configured to generate music sounds based on a performance operation in a main body of the musical instrument, the speaker unit including:

an electrostatic speaker; and a stationary portion, which is a portion fixed to or a member attachable to the main body of the musical instrument, wherein the stationary portion supports the electrostatic speaker so that at least one of a position or a posture of the electrostatic speaker with respect to the stationary portion is variable, wherein the stationary portion has a first guiding portion and a second guiding portion on a common plane;

a movable portion having a first guided portion and a second guided portion that engage the first guiding portion and the second guiding portion, respectively, the movable portion being movable with respect to the stationary portion with the first guided portion and the second guided portion supported by the first guiding portion and the second guiding portion, respectively, wherein the electrostatic speaker is disposed at the movable portion, and wherein at least part of one of the first guiding portion or the second guiding portion is curved as viewed from a direction perpendicular to the common plane, or at least part of the first guiding portion and at least part of the second guiding portion are curved in mutually different directions or curved in mutually different curvatures, as viewed from the direction perpendicular to the common plane.

15. The electronic musical instrument according to claim 14, wherein both of the first guiding portion and the second guiding portion are curved in opposite directions.

16. The electronic musical instrument according to claim 15, wherein a concave side of a curved portion of the first guiding portion and a concave side of a curved portion of the second guiding portion are opposed to each other.

17. The electronic musical instrument according to claim 16, wherein the first guiding portion and the second guiding portion are configured such so that, where a position of the first guiding portion is translated in parallel with a phantom straight line, the curved portion of the first guiding portion and the curved portion of the second guiding portion are symmetric about the phantom straight line.

18. The electronic musical instrument according to claim 16, wherein a movement locus of a middle position between the first guided portion and the second guided portion in the movable portion is substantially linear over an entire range of the movement of the movable portion.

19. The electronic musical instrument according to claim 18, further comprising:

a pinion provided at the middle position in the movable portion; and a rack portion provided at the stationary portion, the rack portion having rack teeth arranged in a straight line and meshing with the pinion.

20. The electronic musical instrument according to claim 14, wherein:

the first guiding portion has a straight portion and a curved portion that is contiguous with the straight portion, the second guiding portion has a straight portion and a curved portion that is contiguous with the straight portion, the straight portion of the first guiding portion and the straight portion of the second guiding portion being parallel to each other.

* * * * *